US011259106B1

(12) United States Patent
Chen et al.

(10) Patent No.: US 11,259,106 B1
(45) Date of Patent: Feb. 22, 2022

(54) MEMS DEVICE WITH DYNAMIC VALVE LAYER

(71) Applicant: Fortemedia, Inc., Santa Clara, CA (US)

(72) Inventors: Chih-Yuan Chen, Tainan (TW); Jien-Ming Chen, Tainan (TW); Feng-Chia Hsu, Tainan (TW); Wen-Shan Lin, Tainan (TW); Nai-Hao Kuo, Tainan (TW)

(73) Assignee: FORTEMEDIA, INC., Santa Clara, CA (US)

( * ) Notice: Subject to any disclaimer, the term of this patent is extended or adjusted under 35 U.S.C. 154(b) by 0 days.

(21) Appl. No.: 17/091,116

(22) Filed: Nov. 6, 2020

(51) Int. Cl.

| | |
|---|---|
| ***H04R 7/00*** | (2006.01) |
| ***H04R 1/08*** | (2006.01) |
| ***H04R 7/06*** | (2006.01) |
| ***H04R 19/04*** | (2006.01) |

(52) U.S. Cl.
CPC ..... *H04R 1/08* (2013.01); *H04R 7/06* (2013.01); *H04R 19/04* (2013.01); *H04R 2201/003* (2013.01)

(58) Field of Classification Search
CPC ..... H04R 19/005; H04R 7/00; H04R 2207/00
USPC ..... 381/175, 429
See application file for complete search history.

(56) References Cited

U.S. PATENT DOCUMENTS

| | | | | |
|---|---|---|---|---|
| 5,975,485 | A * | 11/1999 | Tsai | F15C 5/00 251/11 |
| 6,334,761 | B1 * | 1/2002 | Tai | F16K 99/0009 417/413.3 |
| 8,363,860 | B2 * | 1/2013 | Zhang | H04R 17/02 381/175 |
| 9,630,837 | B1 * | 4/2017 | Chu | B81B 3/0021 |
| 10,343,898 | B1 * | 7/2019 | Chen | H04R 7/08 |
| 2001/0054702 | A1 * | 12/2001 | Williams | F16K 99/0023 251/61 |

* cited by examiner

*Primary Examiner* — Suhan Ni
(74) *Attorney, Agent, or Firm* — McClure, Qualey & Rodack, LLP

(57) ABSTRACT

A micro-electro-mechanical system (MEMS) device is provided. The MEMS device includes a substrate, a backplate disposed on a side of the substrate, a diaphragm, and a dynamic valve layer. The substrate forms an opening. The diaphragm is disposed on the side of the substrate and extends across the opening of the substrate, wherein the diaphragm forms a vent hole. The dynamic valve layer is disposed on the side of the substrate and includes a flap portion, wherein the flap portion covers at least a part of the vent hole when viewed in a direction perpendicular to the diaphragm, and the flap portion deforms when air flows through the vent hole.

23 Claims, 25 Drawing Sheets

MEMS DEVICE WITH DYNAMIC VALVE LAYER

BACKGROUND OF THE INVENTION

Field of the Invention

The invention relates to an acoustic transducer, and more particularly to a micro-electro-mechanical system (MEMS) microphone.

Description of the Related Art

Fabrication of slim, compact, lightweight and high-performance electronic devices, including microphones, is a current trend. A microphone is used to receive sound waves and convert acoustic signals into electric signals. Microphones are widely used in daily life and are installed in such electronic products as telephones, mobiles phones, and recording pens. In a capacitive microphone, variations in acoustic pressure (i.e. local pressure deviation from the ambient atmospheric pressure caused by sound waves) force the diaphragm to deform correspondingly, and the deformation of the diaphragm induces a capacitance variation. The variation of acoustic pressure of the sound waves can thus be obtained by detecting the voltage difference caused by the capacitance variation.

This is distinct from conventional electret condenser microphones (ECM), in which mechanical and electronic elements of micro-electro-mechanical system (MEMS) microphones can be integrated on a semiconductor material using integrated circuit (IC) technology to fabricate a miniature microphone. MEMS microphones have such advantages as a compact size, being lightweight, and having low power consumption, and they have therefore entered the mainstream of miniaturized microphones.

Although existing MEMS microphones have generally been adequate for their intended purposes, they have not been entirely satisfactory in all respects. For example, the compatible acoustic pressure range (i.e. dynamic range) of detectable sound waves in a MEMS microphone still needs improvement. The dynamic range is related to the highest compatible acoustic pressure (i.e. acoustic overload point, which is referred to hereinafter as the "AOP"), which is determined by the harmonic distortion rate (total harmonic distortion, which is referred to hereinafter as the "THD") of the MEMS microphone. On the other hand, if the diaphragm has a lower elastic modulus (i.e. lower stiffness), it can be used to sense a smaller acoustic pressure (i.e. have higher sensitivity), but the THD of the diaphragm will be sacrificed accordingly (i.e. the AOP will be reduced). Therefore, it cannot achieve high AOP, high reliable of air pressure and enhance sensitivity at low frequency, simultaneously, of a MEMS microphone (i.e. unable to achieve a wider dynamic range).

BRIEF SUMMARY OF THE INVENTION

In view of the aforementioned problems, an object of the invention is to provide a MEMS device such as a MEMS microphone that can achieve high AOP, high reliable of air pressure and enhance sensitivity at low frequency simultaneously.

An embodiment of the invention provides a MEMS device. The MEMS device includes a substrate, a backplate disposed on a side of the substrate, a diaphragm, and a dynamic valve layer. The substrate forms an opening. The diaphragm is disposed on the side of the substrate and extends across the opening of the substrate, wherein the diaphragm forms a vent hole. The dynamic valve layer is disposed on the side of the substrate and includes a flap portion, wherein the flap portion covers at least a part of the vent hole when viewed in a direction perpendicular to the diaphragm, and the flap portion deforms when air flows through the vent hole In some embodiments, the micro-electro-mechanical system (MEMS) device further includes a dielectric layer formed between the substrate and the backplate, wherein the dynamic valve layer is embedded in the dielectric layer, and the flap portion protrudes from the dielectric layer and is spaced apart from the diaphragm.

In some embodiments, the dynamic valve layer is located between the diaphragm and the backplate.

In some embodiments, the diaphragm is located between the dynamic valve layer and the backplate.

In some embodiments, the dynamic valve layer has an annular body and a plurality of flap portions extending inward from the annular body.

In some embodiments, the flap portion entirely or partially covers the vent hole when viewed in the direction perpendicular to the diaphragm.

In some embodiments, the flap portion has a protrusion facing the diaphragm.

In some embodiments, the protrusion does not overlap the vent hole when viewed in the direction perpendicular to the diaphragm.

In some embodiments, the protrusion is closer to the edge of the flap portion than the vent hole when viewed in the direction perpendicular to the diaphragm.

In some embodiments, the protrusion is farther from the edge of the flap portion than the vent hole when viewed in the direction perpendicular to the diaphragm.

In some embodiments, the protrusion extends across the vent hole.

In some embodiments, the flap portion has a plurality of protrusions facing the diaphragm and located close to an edge of the flap portion.

In some embodiments, the protrusions do not overlap the vent hole when viewed in the direction perpendicular to the diaphragm.

In some embodiments, the micro-electro-mechanical system (MEMS) device further includes a plurality of ribs formed on the diaphragm and extending toward the interior of the vent hole.

In some embodiments, the micro-electro-mechanical system (MEMS) device further includes a plurality of ribs formed on the dynamic valve layer and extending toward the interior of the vent hole.

In some embodiments, a gap is formed between the flap portion and the diaphragm when viewed in the direction perpendicular to the diaphragm.

In some embodiments, the flap portion of the dynamic valve layer is tadpole-shaped or mushroom-shaped.

In some embodiments, the flap portion of the dynamic valve layer has a spiral shape.

In some embodiments, the dynamic valve layer is supported by a connecting portion which is stacked on the diaphragm. In some embodiments, the flap portion and connecting portion may have different materials.

In some embodiments, the connecting portion has a hollow body, and the dynamic valve layer has a curved slot.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
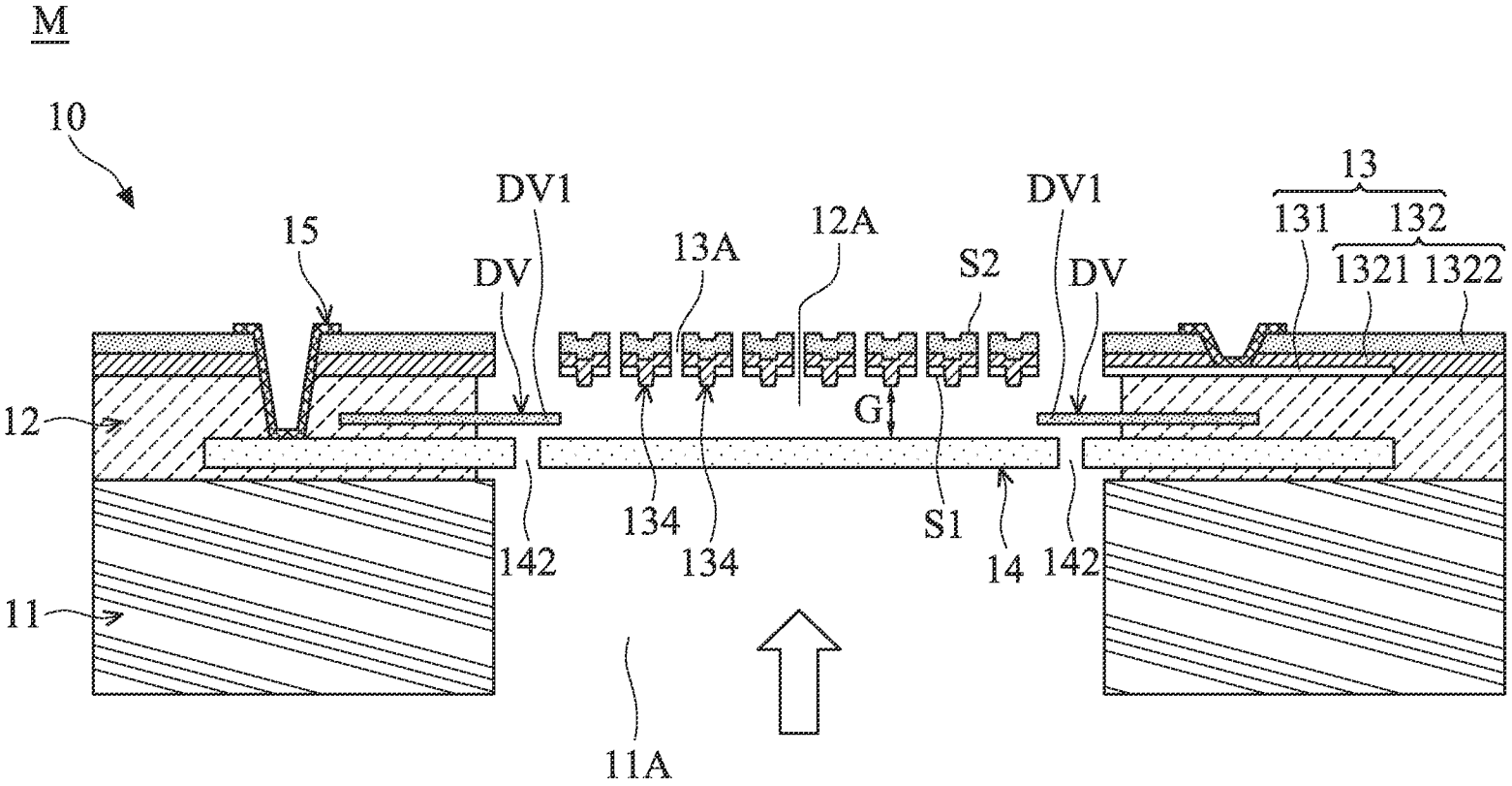
FIG. 1 is a cross-sectional view of a MEMS microphone M, in accordance with some embodiments of the invention.

The following description is of the best-contemplated mode of carrying out the invention. This description is made for the purpose of illustrating the general principles of the invention and should not be taken in a limiting sense. The scope of the invention is best determined by reference to the appended claims.

In the following detailed description, the orientations of "on", "above", "under", and "below" are used for representing the relationship between the relative positions of each element as illustrated in the drawings, and are not meant to limit the invention. Moreover, the formation of a first element on or above a second element in the description that follows may include embodiments in which the first and second elements are formed in direct contact, or the first and second elements have one or more additional elements formed therebetween.

In addition, the present disclosure may repeat reference numerals and/or letters in the various examples. This repetition is for the purpose of simplicity and clarity and does not in itself dictate a relationship between the various embodiments and/or configurations discussed. Various features may be arbitrarily drawn in different scales for the sake of simplicity and clarity. Furthermore, some elements not shown or described in the embodiments have the forms known by persons skilled in the field of the invention.

In the present disclosure, a micro-electro-mechanical system (MEMS) microphone for detecting sound waves and converting the sound waves (acoustic signal) into electric signal is provided, in accordance with various exemplary embodiments. In particular, the MEMS microphones in the various embodiments can achieve high reliable of air pressure and enhance sensitivity at low frequency simultaneously via the following described features. The variations of some embodiments are discussed. Throughout the various views and illustrative embodiments, like reference numbers are used to designate like elements.

FIG. 1 is a cross-sectional view of a MEMS microphone M, in accordance with some embodiments of the invention.

It should be noted that the MEMS microphone M depicted in FIG. 1 has been simplified for the sake of clarity to better understand the inventive concepts of the present disclosure. Additional features can be added into the MEMS microphone M, and some of the features described below can be replaced or eliminated in other embodiments of the MEMS microphone M. As shown in FIG. 1, the MEMS microphone M which is a capacitive microphone includes a MEMS structure 10 including a substrate 11, a dielectric layer 12, a backplate 13, a diaphragm 14, and an electrode layer 15.

The substrate 11 is configured to support the dielectric layer 12, the backplate 13, the diaphragm 14, and the electrode layer 15 on a side thereof. The substrate 11 may have an opening 11A which allows sound waves (e.g., as the arrow indicated in FIG. 1) received by the MEMS microphone M to pass through and/or enter the MEMS structure 10. The substrate 11 may be made of silicon or the like.

The dielectric layer 12 is disposed between the substrate 11 and the diaphragm 14, and between the diaphragm 14 and the backplate 13, so as to provide partial isolation between the substrate 11, the diaphragm 14, and the backplate 13 from each other. Moreover, the dielectric layer 12 is disposed around the backplate 13 and the diaphragm 14, such that the backplate 13 and the diaphragm 14 are clamped at their edges by the dielectric layer 12. Furthermore, the dielectric layer 12 may have an opening 12A corresponding to the opening 11A of the substrate 11, so as to allow the sound waves to pass through the diaphragm 14 and the backplate 13 and then leave the MEMS structure 10. The dielectric layer 12 may be made of silicon oxide or the like.

The backplate 13 is a stationary element disposed on a side of the substrate 11. The backplate 13 may have sufficient stiffness such that it would not be bending or movable when the sound waves pass through the backplate 13. In some embodiments, the backplate 13 is a stiff perforated element including a number of acoustic holes 13A each passing through the backplate 13, as shown in FIG. 1. The acoustic holes 13A are configured to allow the sound waves to pass through.

In some embodiments, the backplate 13 includes a conductive layer 131 and an insulating layer 132 covering the conductive layer 131 for protection, as shown in FIG. 1. The conductive layer 131 and the insulating layer 132 are respectively located on a first side S1 of the backplate 13 facing the diaphragm 14 and a second side S2 of the backplate 13 opposite to the first side S1. The conductive layer 131 may be made of poly-silicon or the like, and the insulating layer 132 may be made of silicon nitride or the like.

In some embodiments, the MEMS structure 10 is electrically connected to a circuit (not shown) via several electrode pads of the electrode layer 15 that is disposed on the backplate 13 and electrically connected to the conductive layer 131 and the diaphragm 14. In some embodiments, the electrode layer 15 comprises copper, silver, gold, aluminum, or alloy thereof.

The diaphragm 14 is movable or displaceable relative to the backplate 13. The diaphragm 14 is configured to sense the sound waves received by the MEMS microphone M.

The displacement change of the diaphragm 14 relative to the backplate 13 causes a capacitance change between the diaphragm 14 and the backplate 13. The capacitance change is then converted into an electric signal by circuitry connected with the diaphragm 14 and the backplate 13, and the electrical signal is sent out of the MEMS microphone M through the electrode layer 15.

On the other hand, in order to increase the sensitivity of the diaphragm 14, a number of vent holes 142 may be provided in the diaphragm 14 and to serve as a spring in the diaphragm 14 to reduce the stiffness of the diaphragm 14. In some alternative embodiments, there may be more than two vent holes 142. With this structural feature, high sensitivity of the MEMS microphone M can be achieved.

In addition, the vent holes 142 in the diaphragm 14 are also configured to relieve the high air pressure on the diaphragm 14.

In some embodiments, a number of insulating protrusions 134 are provided or formed on the first side S1 of the backplate 13, and an air gap G is formed between the diaphragm 14 and each of the insulating protrusions 134, as shown in FIG. 1. In addition, the air gap G between the diaphragm 14 and each of the insulating protrusions 134 may be the same (but not limited thereto).

Still referring to FIG. 1, to form the insulating protrusions 134, the insulating layer 132 of the backplate 13 may include a first insulating layer 1321 and a second insulating layer 1322 stacked on the first insulating layer 1321. In some embodiments, the first and second insulating layers 1321 and 1322 may comprise the same material or different material.

Specifically, the MEMS structure 10 in FIG. 1 further comprises a dynamic valve layer DV that is embedded into the dielectric layer 12 and has at least one flap portion DV1 protruding from the dielectric layer 12 and spaced apart from the diaphragm 14. When the diaphragm 14 is affected by acoustic pressure from ambient sound waves, air can flow sequentially through the opening 11A and the vent holes 142, as the arrow indicated in FIG. 1, so that the flap portions DV1 of the dynamic valve layer DV deform to relieve the air pressure and endure the wind load on the diaphragm 14.

Figure 2A:
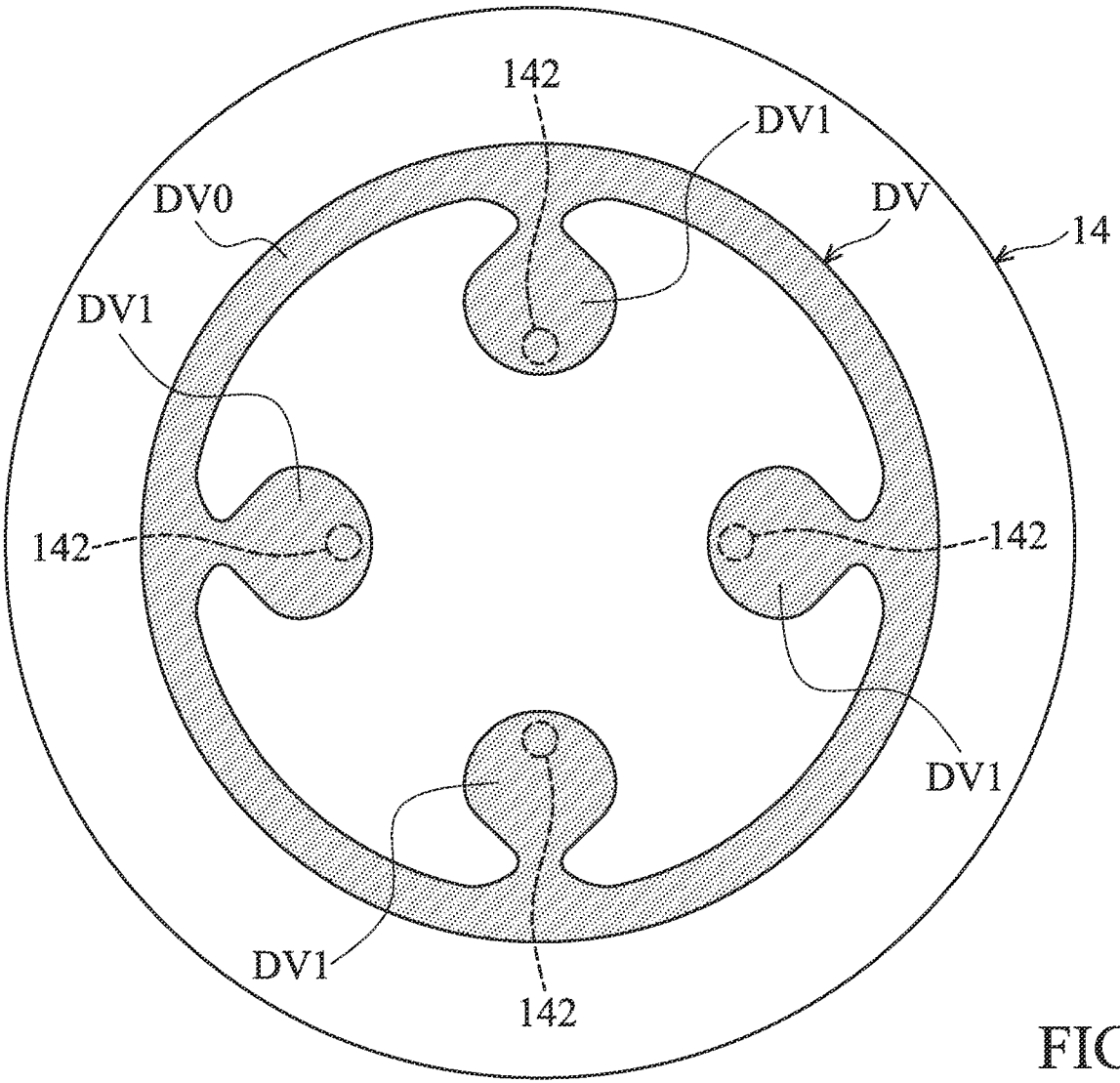
FIG. 2A is a top view of the diaphragm 14 and the dynamic valve layer DV in FIG. 1.

FIG. 2A is a top view of the diaphragm 14 and the dynamic valve layer DV in FIG. 1. In this embodiment, the diaphragm 14 and the dynamic valve layer DV both have a round shape, wherein the diameter of the dynamic valve layer DV is less than the diaphragm 14. Moreover, the diaphragm 14 has four vent holes 142, and the diaphragm 14 has an annular body DV0 and four tadpole-shaped flap portions DV1 extending inward from the annular body DV0, wherein the flap portions DV1 are located corresponding to the four vent holes 142. It should be noted that when viewed in a direction perpendicular to the diaphragm 14, the flap portions DV1 entirely cover the vent holes 142, as shown in FIG. 2A.

Figure 2B:
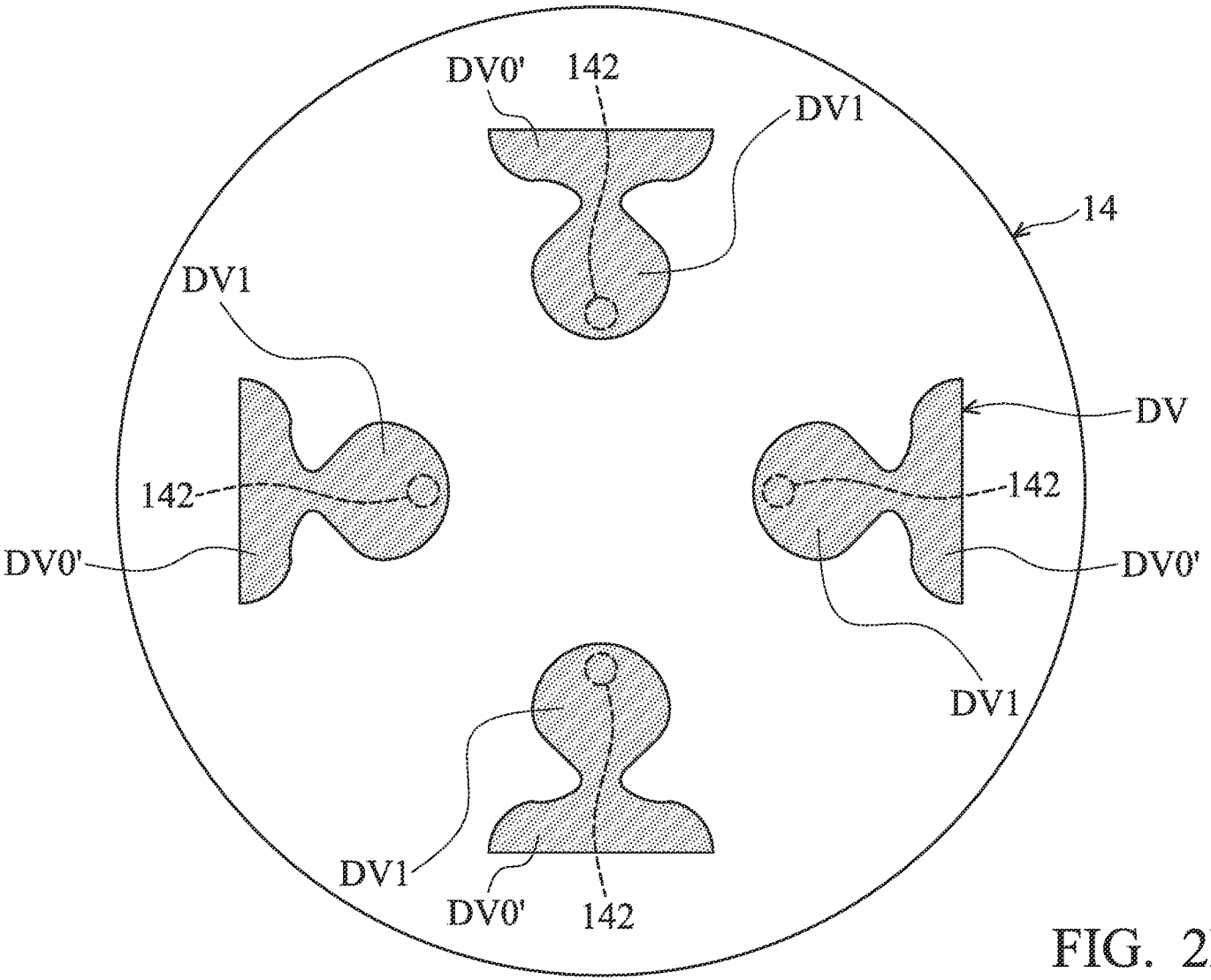
FIG. 2B is a top view of the diaphragm 14 and the dynamic valve layer DV in accordance with another embodiment of the invention.

FIG. 2B is a top view of the diaphragm 14 and the dynamic valve layer DV in accordance with another embodiment of the invention. This embodiment is different from FIG. 2A in that the dynamic valve layer DV includes a plurality of fixed portions DV0' and a plurality of flap portions DV1 extending inward from the fixed portions DV0'. It should be noted that the fixed portions DV0' are embedded in the dielectric layer 12 and spaced apart from each other. The flap portions DV1 protrude from the dielectric layer 12 and are spaced apart from the diaphragm 14, as the cross-sectional view of the MEMS microphone M shown in FIG. 1.

Figure 2C:
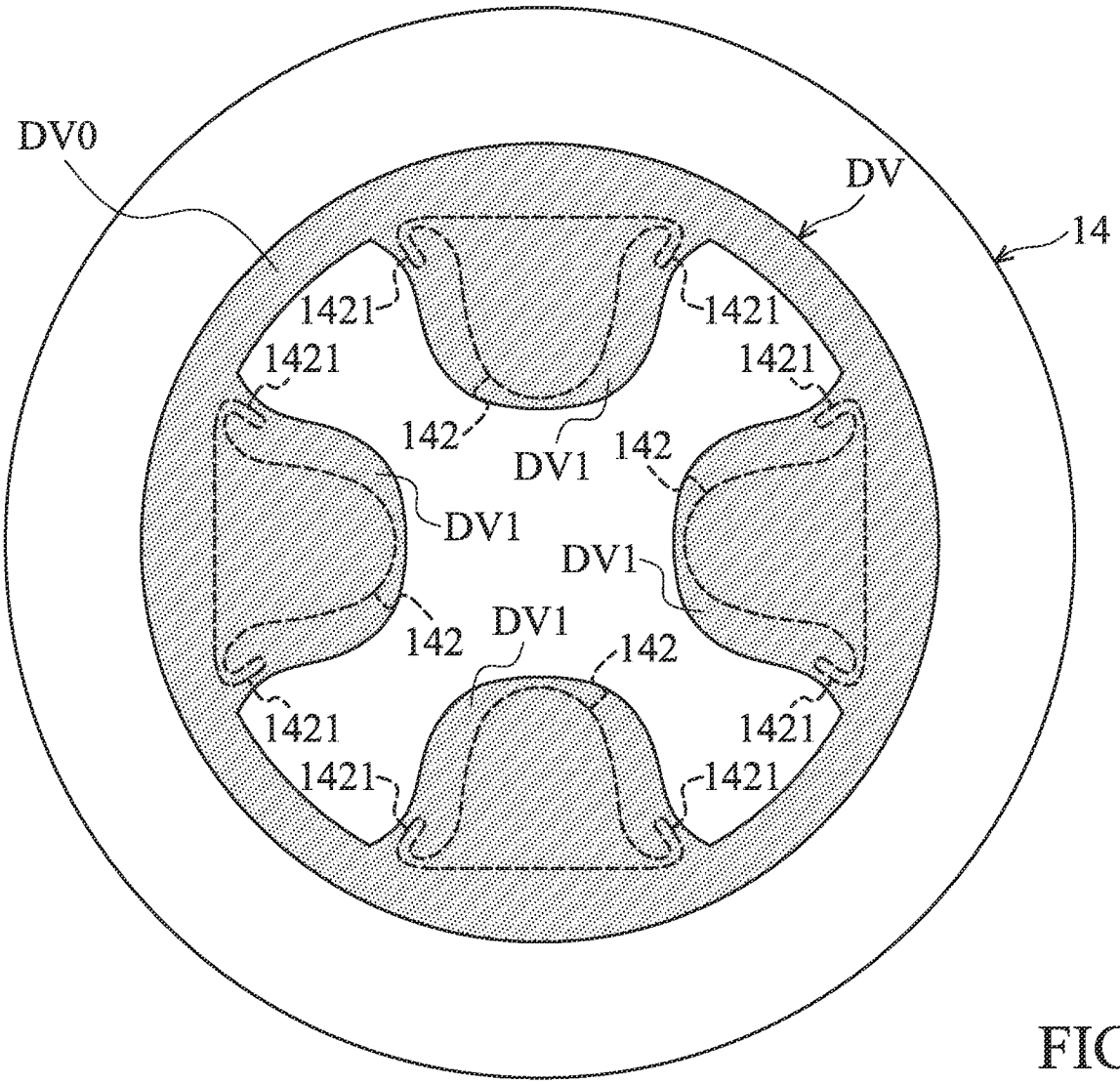
FIG. 2C is a top view of the diaphragm 14 and the dynamic valve layer DV in accordance with another embodiment of the invention.

FIG. 2C is a top view of the diaphragm 14 and the dynamic valve layer DV in accordance with another embodiment of the invention. This embodiment is different from FIG. 2A in that the vent hole 142 has a substantially semicircular shape, and two curved slots 1421 are formed on opposite sides of the vent hole 142. Moreover, the diaphragm 14 has an annular body DV0 and several semicircular flap portions DV1 extending inward from the annular body DV0. It should be noted that the flap portions DV1 entirely cover the four vent holes 142 and the curved slots 1421 when viewed in a direction perpendicular to the diaphragm 14.

Figure 2D:
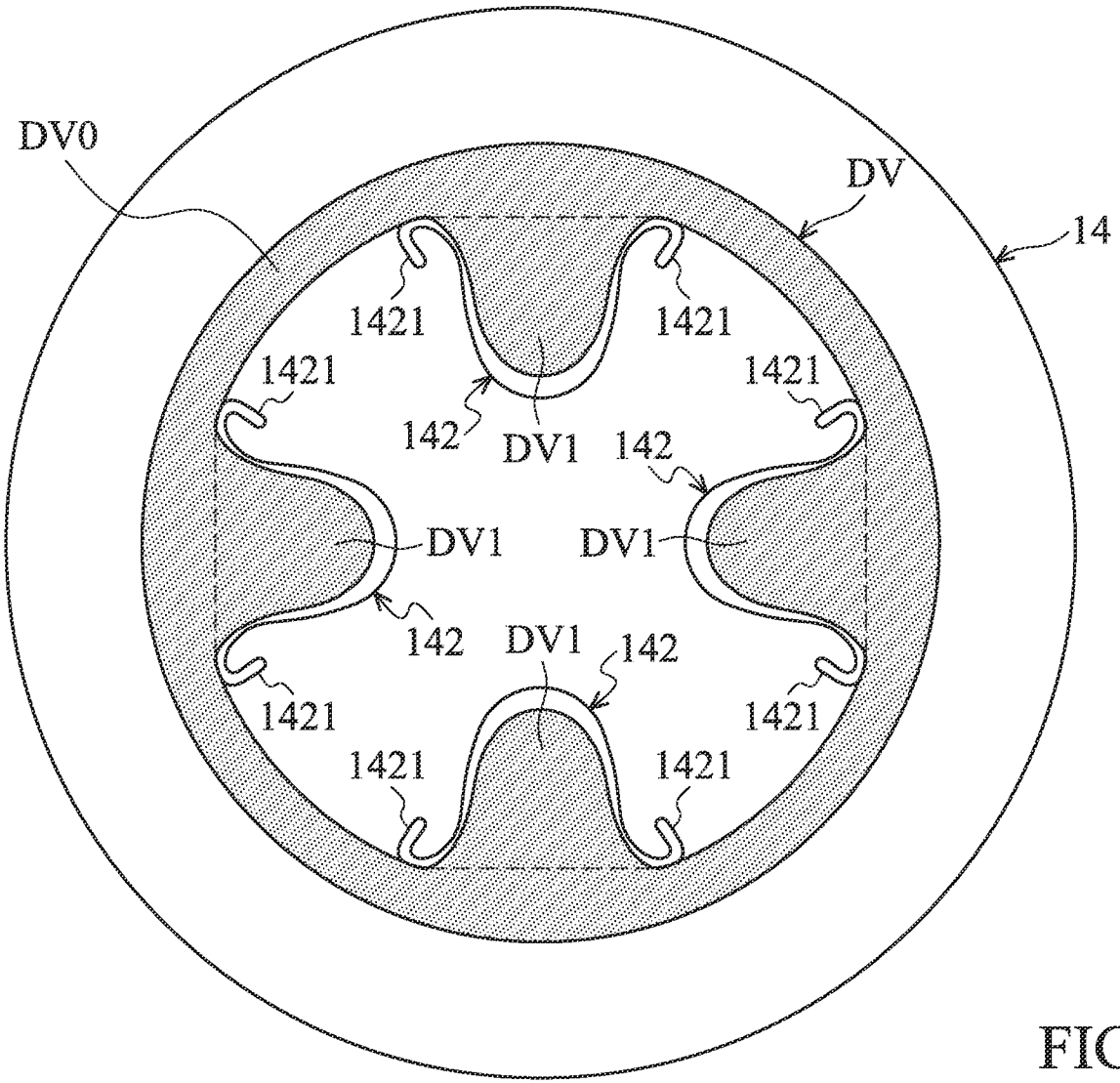
FIG. 2D is a top view of the diaphragm 14 and the dynamic valve layer DV in accordance with another embodiment of the invention.

FIG. 2D is a top view of the diaphragm 14 and the dynamic valve layer DV in accordance with another embodiment of the invention. This embodiment is different from FIG. 2C in that when viewed in a direction perpendicular to the diaphragm 14, the flap portions DV1 partially covers the vent holes 142.

Figure 3:
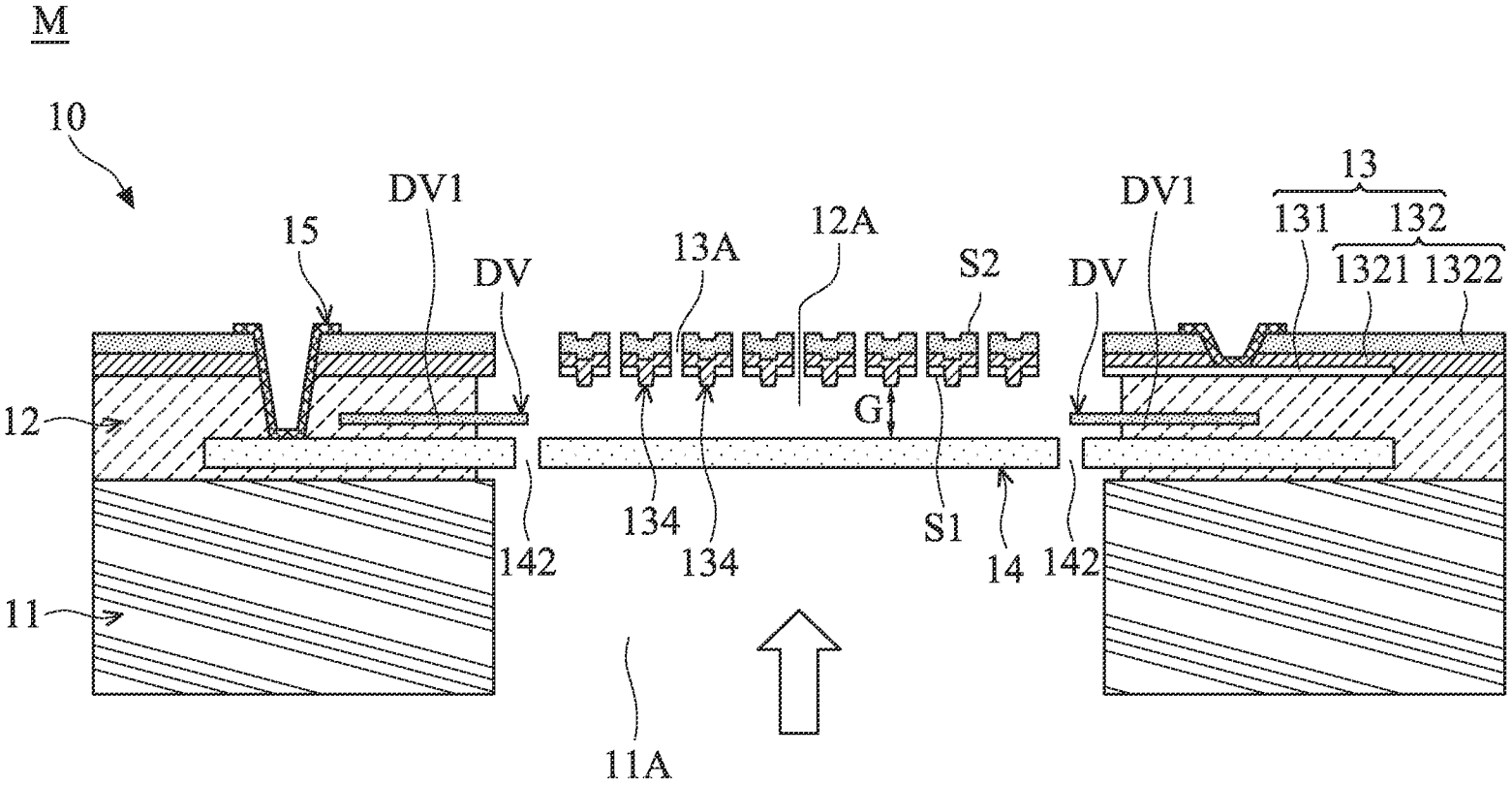
FIG. 3 is a cross-sectional view of a MEMS microphone M, in accordance with another embodiment of the invention.
Figure 4:
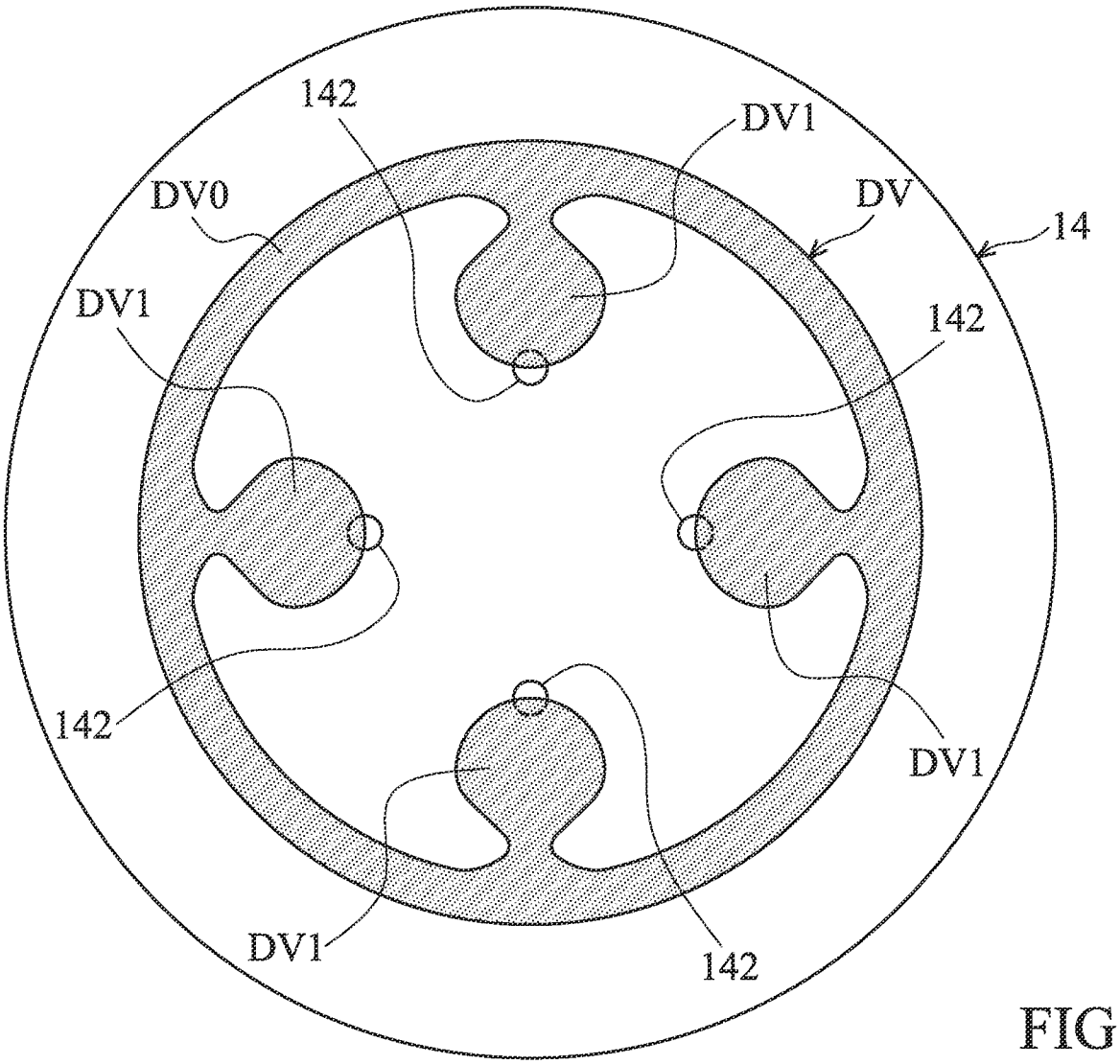
FIG. 4 is a top view of the diaphragm 14 and the dynamic valve layer DV in FIG. 3.

FIG. 3 is a cross-sectional view of a MEMS microphone M, in accordance with another embodiment of the invention, and FIG. 4 is a top view of the diaphragm 14 and the dynamic valve layer DV in FIG. 3. Referring to FIGS. 3 and 4, the MEMS microphone M in this embodiment is different from FIG. 1 in that the flap portions DV1 of the dynamic valve layer DV partially cover the vent holes 142 of the diaphragm 14.

Figure 5:
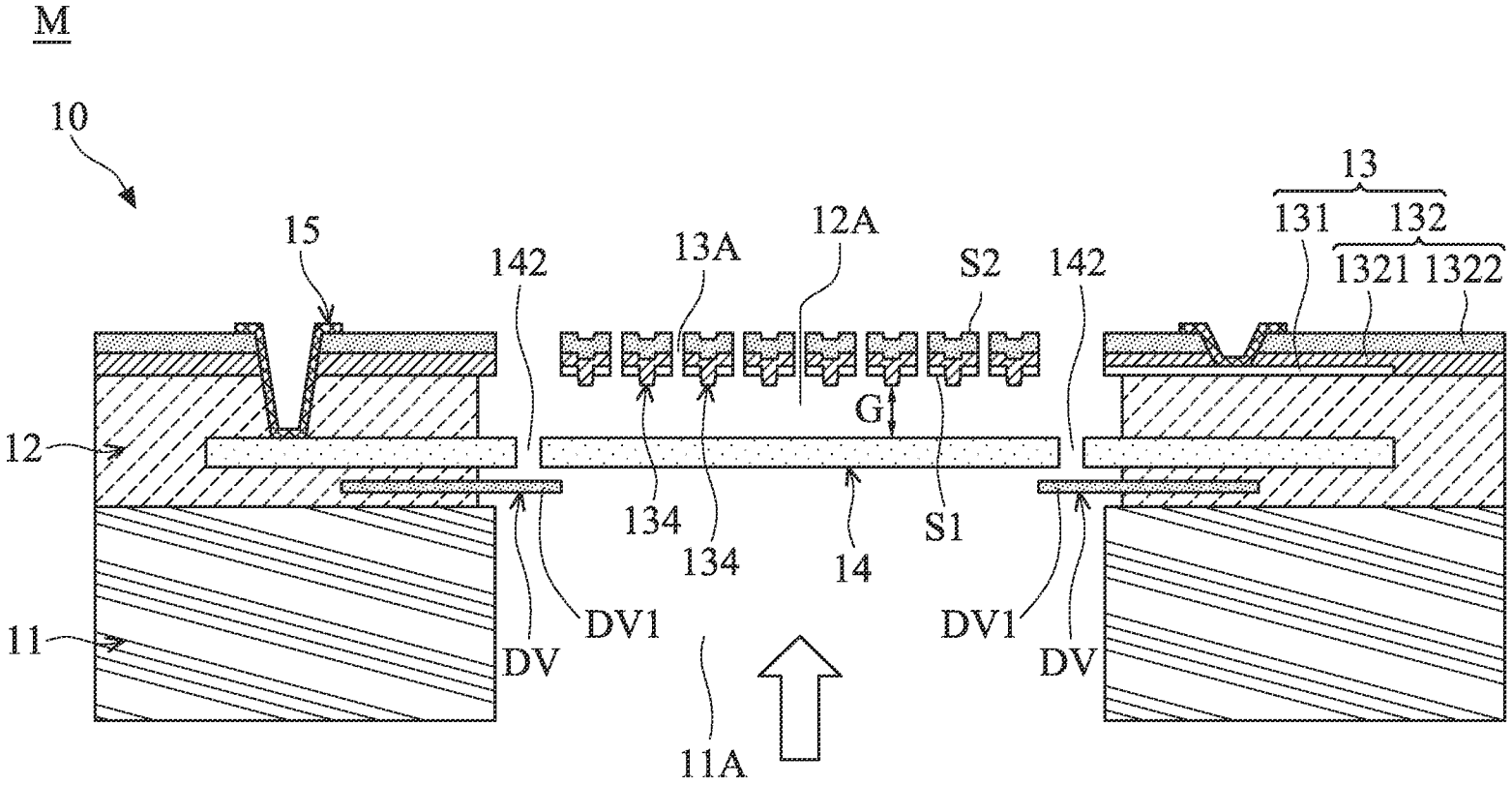
FIG. 5 is a cross-sectional view of a MEMS microphone M, in accordance with another embodiment of the invention.

FIG. 5 is a cross-sectional view of a MEMS microphone M, in accordance with another embodiment of the invention. Referring to FIG. 5, the MEMS microphone M in this embodiment is different from FIG. 1 in that the flap portions DV1 of the dynamic valve layer DV are located below the diaphragm 14. When the diaphragm 14 is affected by acoustic pressure from ambient sound waves, air can flow sequentially through the opening 11A and the vent holes 142, as the arrow indicated in FIG. 5, and the flap portions DV1 of the dynamic valve layer DV can deform to relieve the air pressure and endure the wind load on the diaphragm 14.

Figure 6:
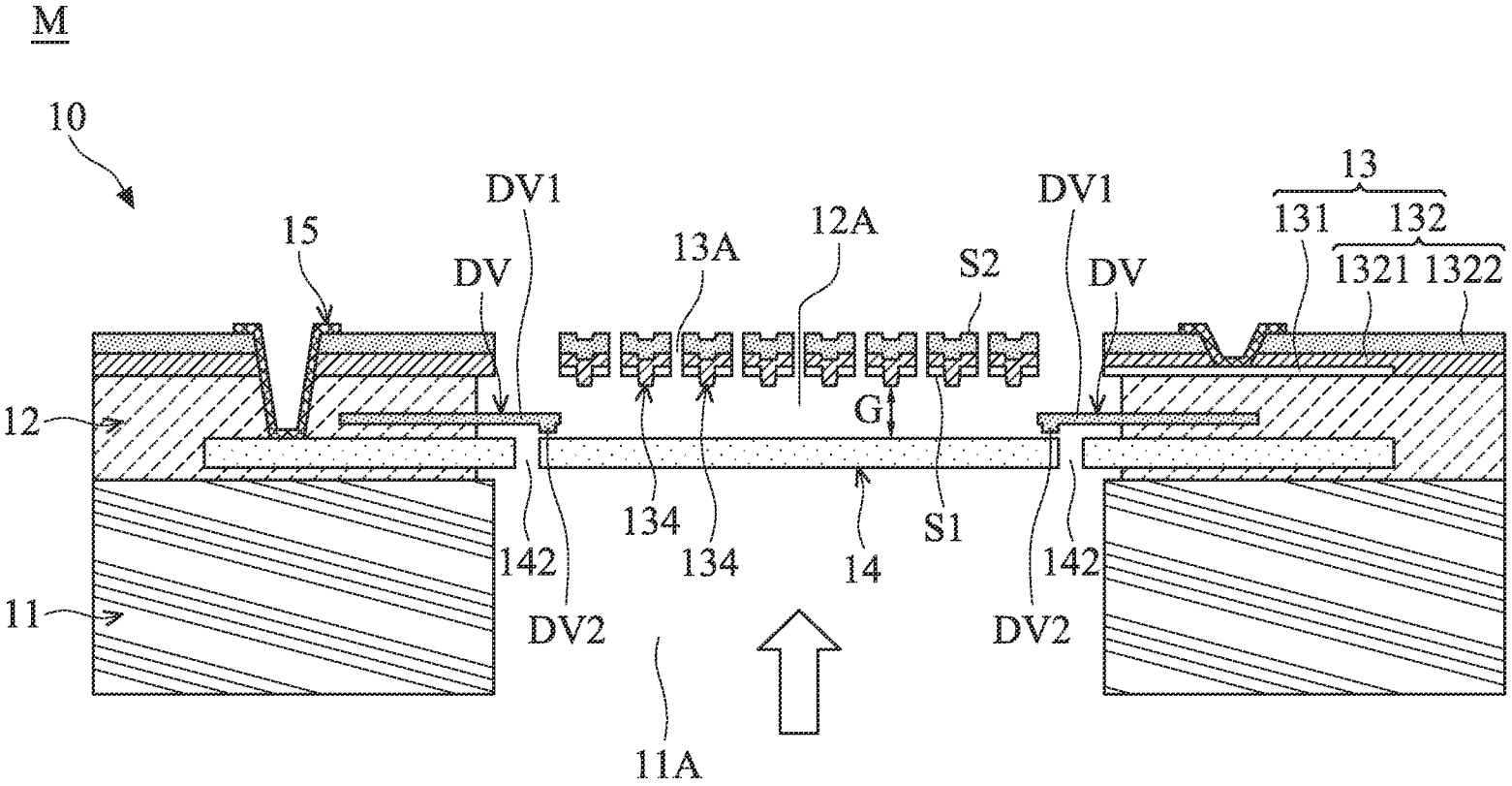
FIG. 6 is a cross-sectional view of a MEMS microphone M, in accordance with another embodiment of the invention.

FIG. 6 is a cross-sectional view of a MEMS microphone M, in accordance with another embodiment of the invention. Referring to FIG. 6, the MEMS microphone M in this embodiment is different from FIG. 1 in that the flap portions DV1 of the dynamic valve layer DV respectively form a protrusion DV2 facing the diaphragm 14. Thus, the flap portions DV1 can be prevented from sticking to the diaphragm 14. It should be noted that the protrusions DV2 in FIG. 6 are closer to the edge of the flap portion DV1 than the vent hole 142 when viewed in a direction perpendicular to the diaphragm 14.

Figure 7:
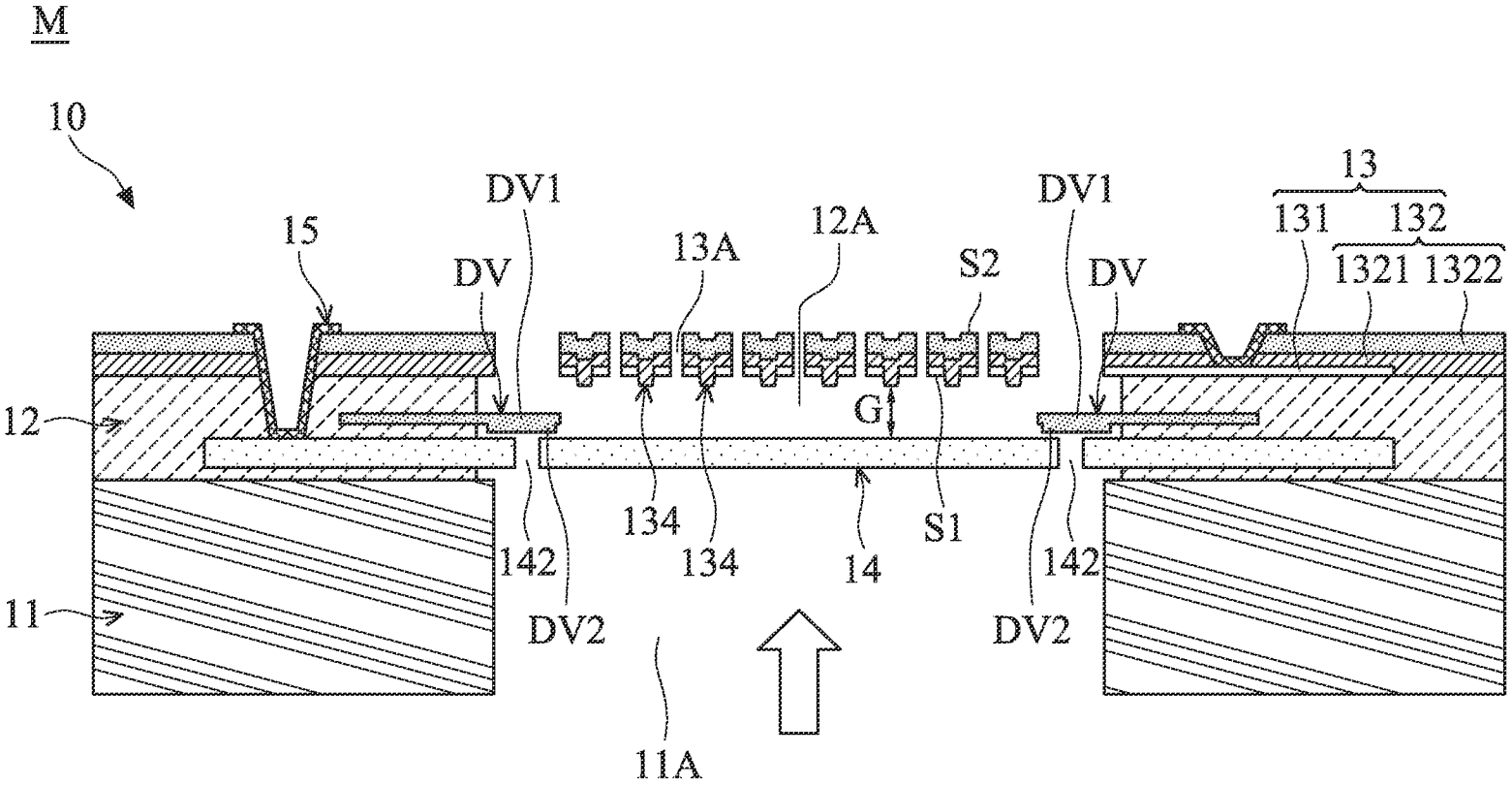
FIG. 7 is a cross-sectional view of a MEMS microphone M, in accordance with another embodiment of the invention.

FIG. 7 is a cross-sectional view of a MEMS microphone M, in accordance with another embodiment of the invention. Referring to FIG. 7, the MEMS microphone M in this embodiment is different from FIG. 6 in that the protrusions DV2 on the flap portions DV1 extend across the vent holes 142, so as to increase the thickness of the flap portions DV1 and avoid curl problems. In some embodiments, the protrusion DV2 in FIGS. 6 and 7 can be integrally formed with the dynamic valve layer DV in one piece, so that the dynamic valve layer DV has a non-uniform thickness. In some embodiments, the dynamic valve layer DV may comprise a multilayer structure to form the protrusion DV1 when viewed in a direction parallel to the diaphragm 14.

Figure 8:
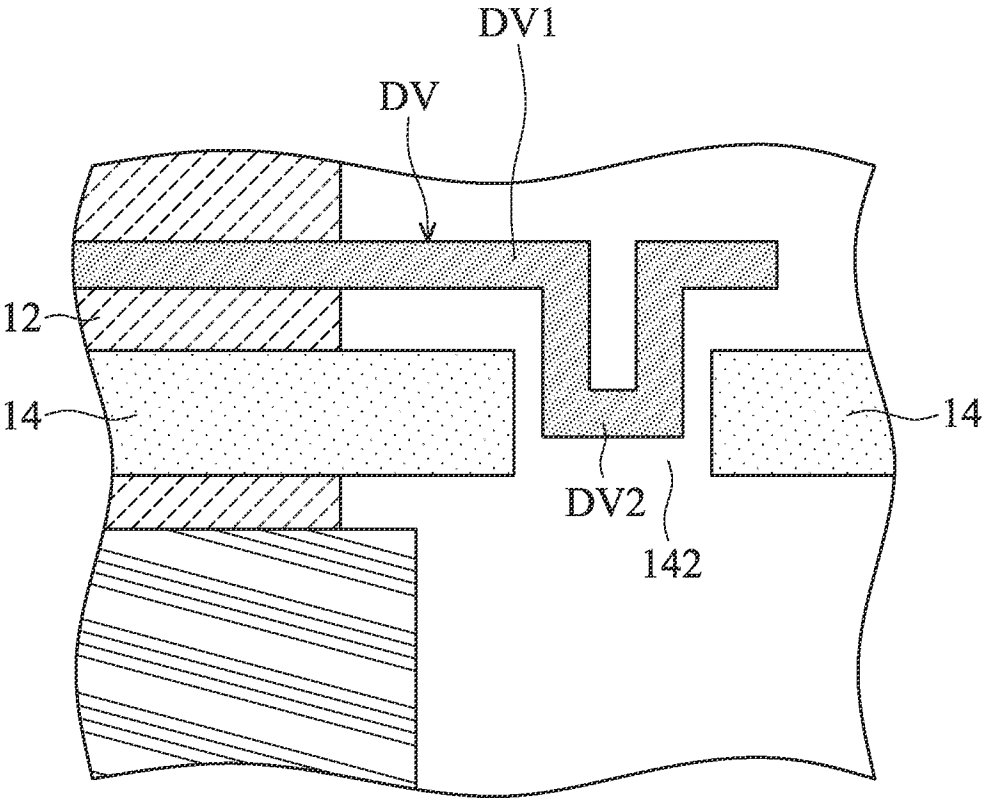
FIG. 8 is a partial enlarged cross-sectional view of a MEMS microphone M, in accordance with another embodiment of the invention.

FIG. 8 is a partial enlarged cross-sectional view of a MEMS microphone M, in accordance with another embodiment of the invention. Referring to FIG. 8, the MEMS microphone M in this embodiment is different from FIG. 6 in that the flap portion DV1 of the dynamic valve layer DV forms a protrusion DV2 facing the vent holes 142. It should be noted that the protrusion DV2 has a concave or convex structure and extends into the vent hole 142. Specifically, when viewed in the direction perpendicular to the diaphragm 14, the protrusion DV2 is located in the vent hole 142.

As mentioned above, the dynamic valve layer DV may be formed above or below the diaphragm 14, and the flap portions DV1 of the dynamic valve layer DV may have a protrusion DV2 facing the diaphragm 14.

Figure 9:
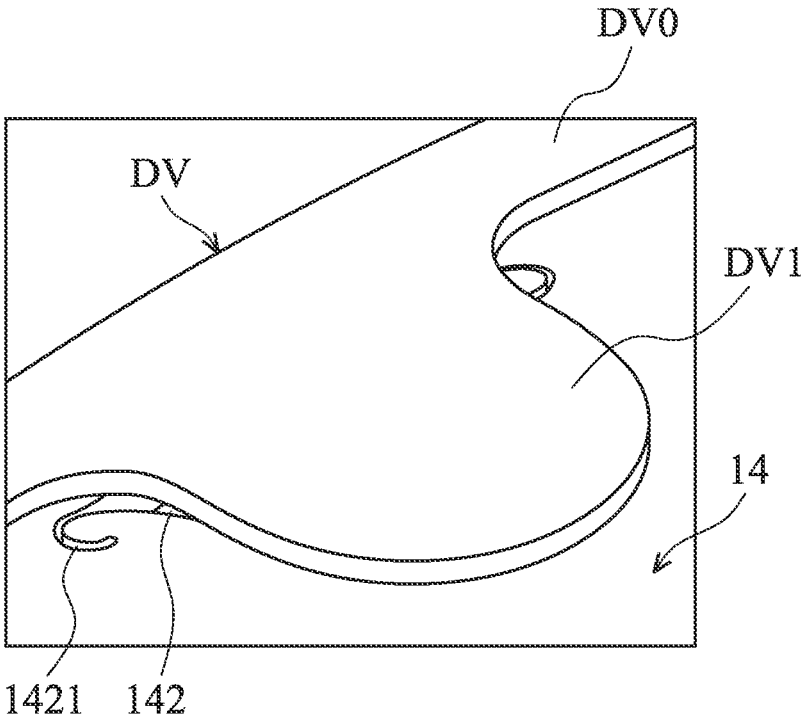
FIG. 9 is a partial enlarged top perspective view of a diaphragm 14 and a dynamic valve layer DV located above the diaphragm 14, in accordance with some embodiments of the invention.
Figure 10:
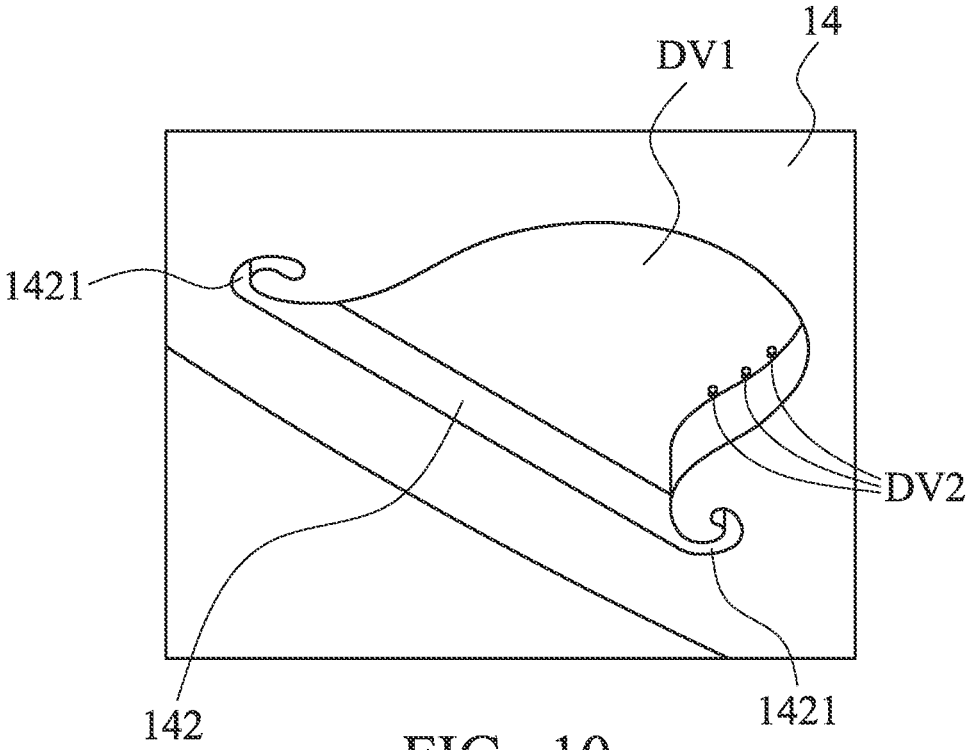
FIG. 10 is a partial enlarged bottom perspective view of the diaphragm 14 and the dynamic valve layer DV in FIG. 9.

FIG. 9 is a partial enlarged top perspective view of a diaphragm 14 and a dynamic valve layer DV located above the diaphragm 14, in accordance with some embodiments of the invention. FIG. 10 is a partial enlarged bottom perspective view of the diaphragm 14 and the dynamic valve layer DV in FIG. 9.

Referring to FIGS. 9 and 10, the dynamic valve layer DV in this embodiment has an annular body DV0 and at least a flap portion DV1 that has a substantially semicircular shape. The flap portion DV1 extends inward from the annular body DV0 and partially cover a vent hole 142 of the diaphragm 14 when viewed in a direction perpendicular to the diaphragm 14. Here, the vent hole 142 also has a substantially semicircular shape corresponding to a flap portion DV1, wherein two curved slots 1421 are formed on opposite sides of the vent hole 142. It should be noted that the flap portion DV1 of the dynamic valve layer DV may cover or not cover the curved slots 1421 when viewed in a direction perpendicular to the diaphragm 14.

Figure 11:
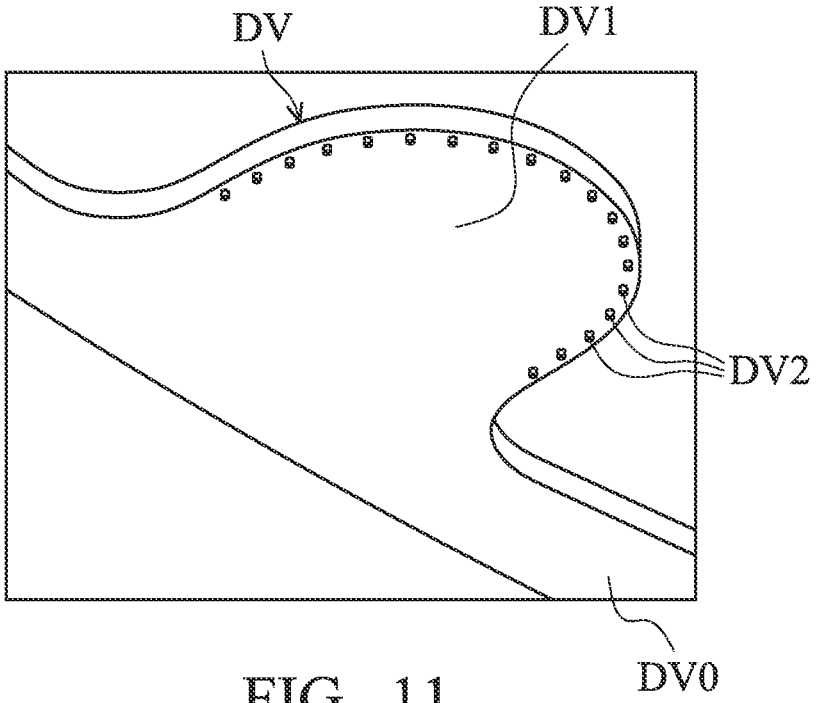
FIG. 11 is a bottom perspective view of several protrusions DV2 formed on a flap portion DV1 of the dynamic valve layer DV in FIG. 10.
Figure 12:
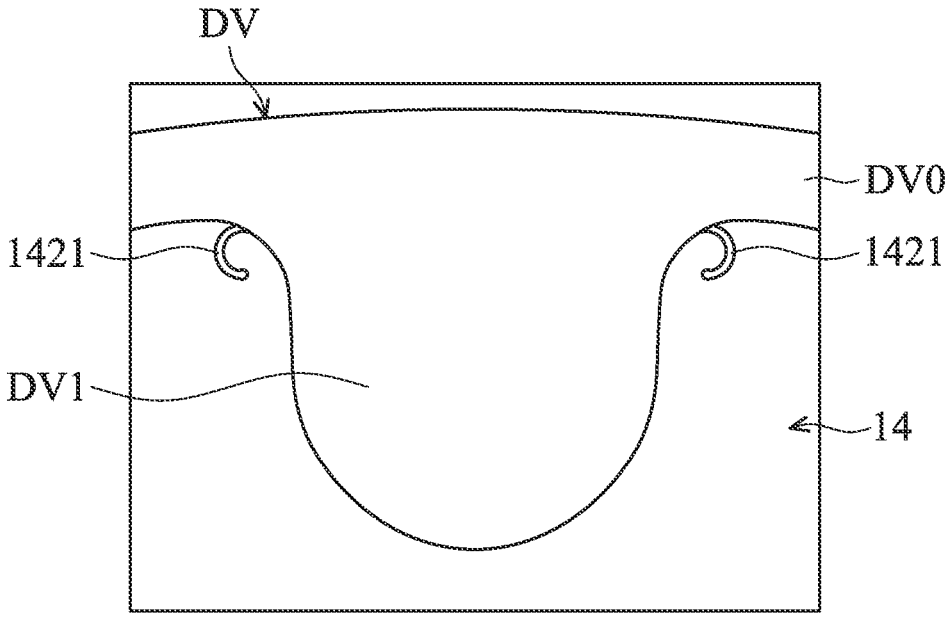
FIG. 12 is a partial enlarged top view of the diaphragm 14 and the dynamic valve layer DV in FIGS. 9 and 10.
Figure 13:
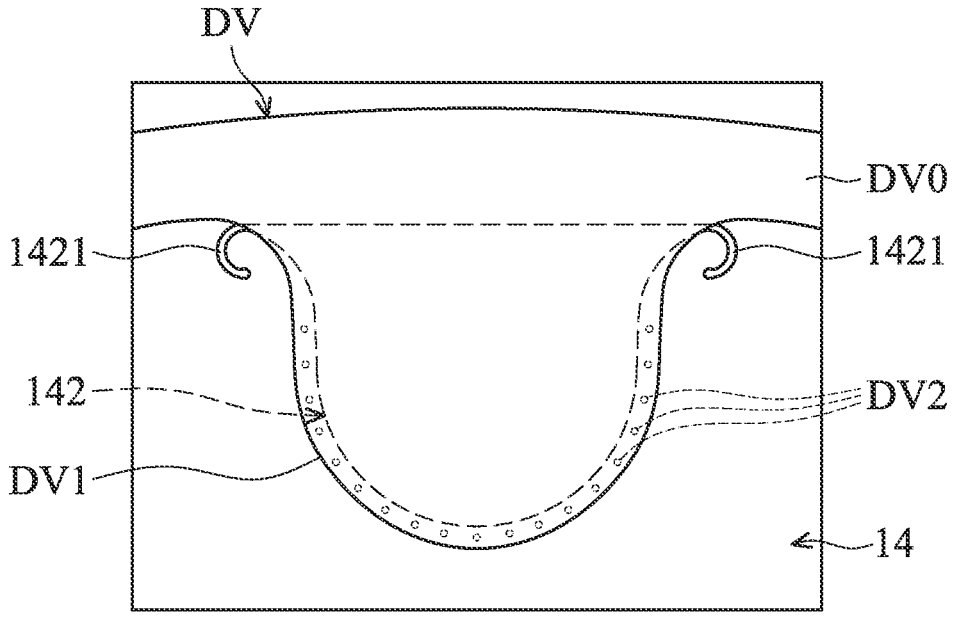
FIG. 13 is another partial enlarged top view of the diaphragm 14 and the dynamic valve layer DV, wherein the protrusions DV2 are located close to a curved edge of the flap portion DV1 and face the diaphragm 14.
Figure 14:
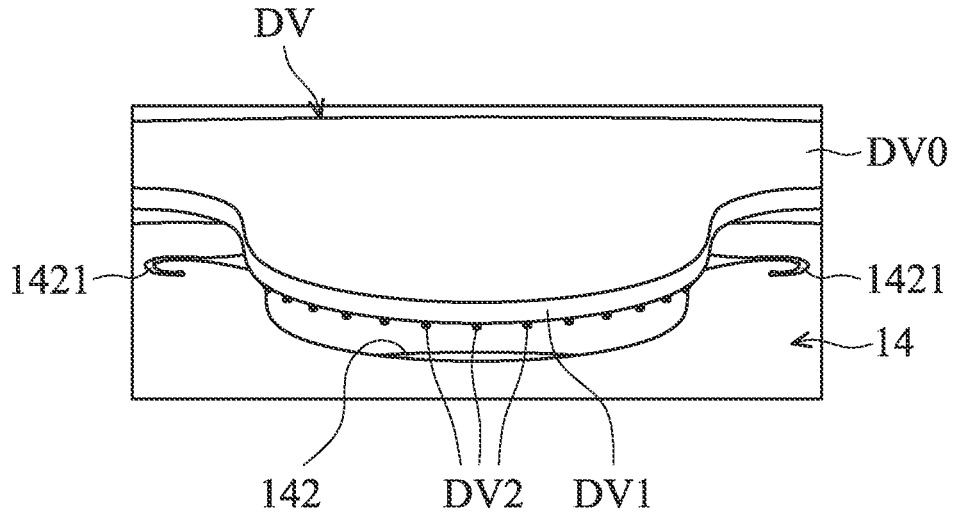
FIG. 14 is another partial enlarged perspective view of the diaphragm 14 and the dynamic valve layer DV in FIGS. 9 and 10.

FIG. 11 is a bottom perspective view of several protrusions DV2 formed on a flap portion DV1 of the dynamic valve layer DV in FIG. 10. FIG. 12 is a partial enlarged top view of the diaphragm 14 and the dynamic valve layer DV in FIGS. 9 and 10. FIG. 13 is another partial enlarged top view of the diaphragm 14 and the dynamic valve layer DV, wherein the protrusions DV2 are located close to a curved edge of the flap portion DV1 and face the diaphragm 14. FIG. 14 is another partial enlarged perspective view of the diaphragm 14 and the dynamic valve layer DV in FIGS. 9 and 10.

As shown in FIGS. 10-14, several protrusions DV2 (e.g. dimples or ribs) are formed on the bottom surface of the flap portion DV1 that faces the diaphragm 14. The protrusions DV2 are located close to the curved edge of the flap portion DV1 and face the diaphragm 14. Moreover, the protrusions DV2 can be used as spacers to separate the flap portion DV1 from the diaphragm 14, whereby the flap portion DV1 can be prevented from sticking to the diaphragm 14. It should be noted that the protrusions DV2 in FIG. 13 do not overlap the vent hole 142 when viewed in a direction perpendicular to the diaphragm 14.

Figure 15:
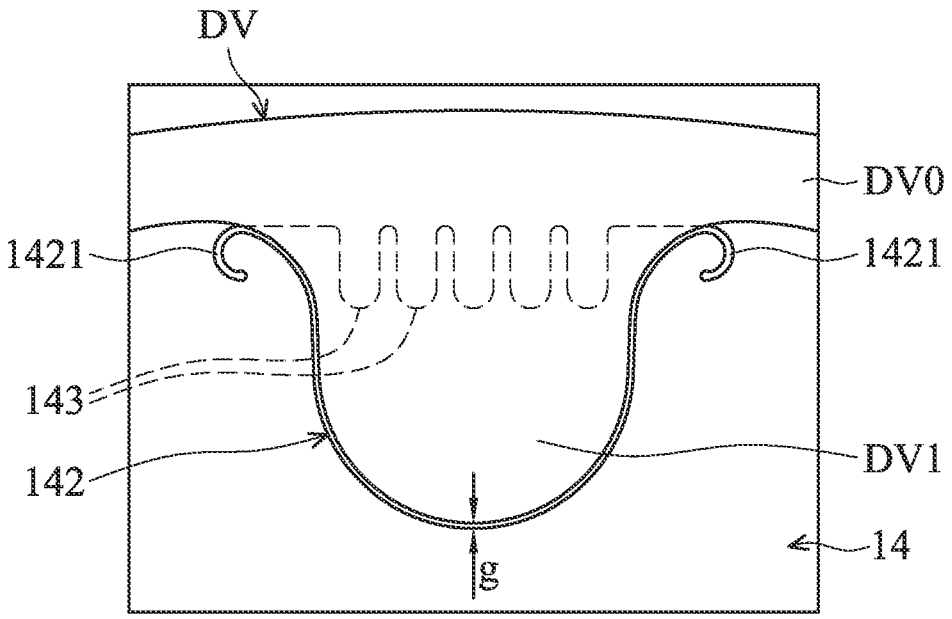
FIG. 15 is a partial enlarged top view of a diaphragm 14 and a dynamic valve layer DV located above the diaphragm 14, in accordance with another embodiment of the invention.
Figure 16:
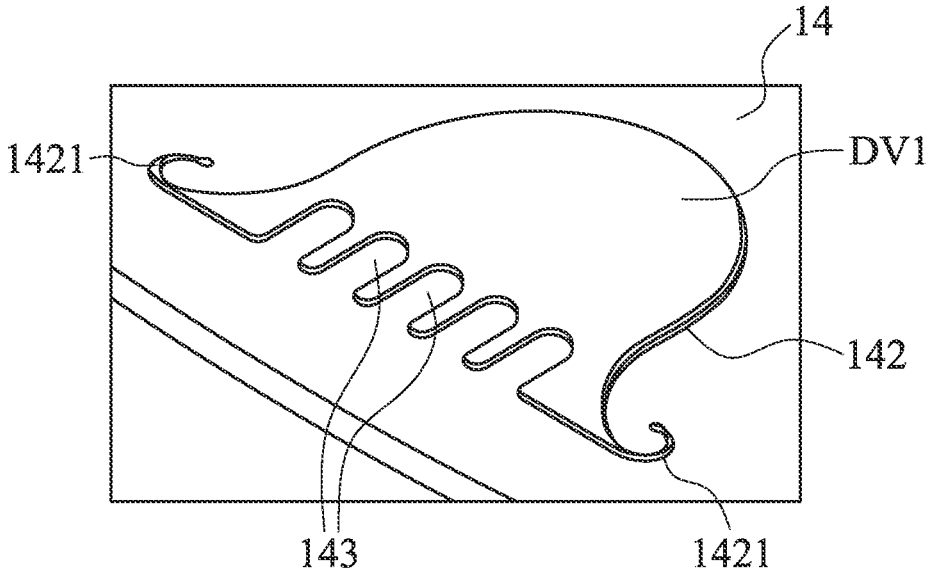
FIG. 16 is a partial enlarged bottom perspective view of the diaphragm 14 and the dynamic valve layer DV in FIG. 15.

FIG. 15 is a partial enlarged top view of a diaphragm 14 and a dynamic valve layer DV located above the diaphragm 14, in accordance with another embodiment of the invention. FIG. 16 is a partial enlarged bottom perspective view of the diaphragm 14 and the dynamic valve layer DV in FIG. 15.

Referring to FIGS. 15 and 16, the diaphragm 14 and the dynamic valve layer DV in this embodiment is different from FIGS. 9-14 in that the flap portion DV1 of the dynamic valve layer DV does not extend across the vent hole 142 of the diaphragm 14, and no protrusion is formed on the bottom surface of the flap portion DV1. Moreover, several ribs 143 are formed on the diaphragm 14 and extend toward the interior of the vent hole 142, thereby enhancing the structural strength of the diaphragm 14. As shown in FIG. 15, since the flap portion DV1 of the dynamic valve layer DV does not extend across the vent hole 142, a gap g is formed between the flap portion DV1 and the diaphragm 14 when viewed in a direction perpendicular to the diaphragm 14.

In some embodiments, several ribs (not shown) may be formed on the dynamic valve layer DV and may extend from the annular body DV0 toward the interior of the vent hole 142 when viewed in a direction perpendicular to the diaphragm 14, thereby enhancing the structural strength of the dynamic valve layer DV.

Figure 17:
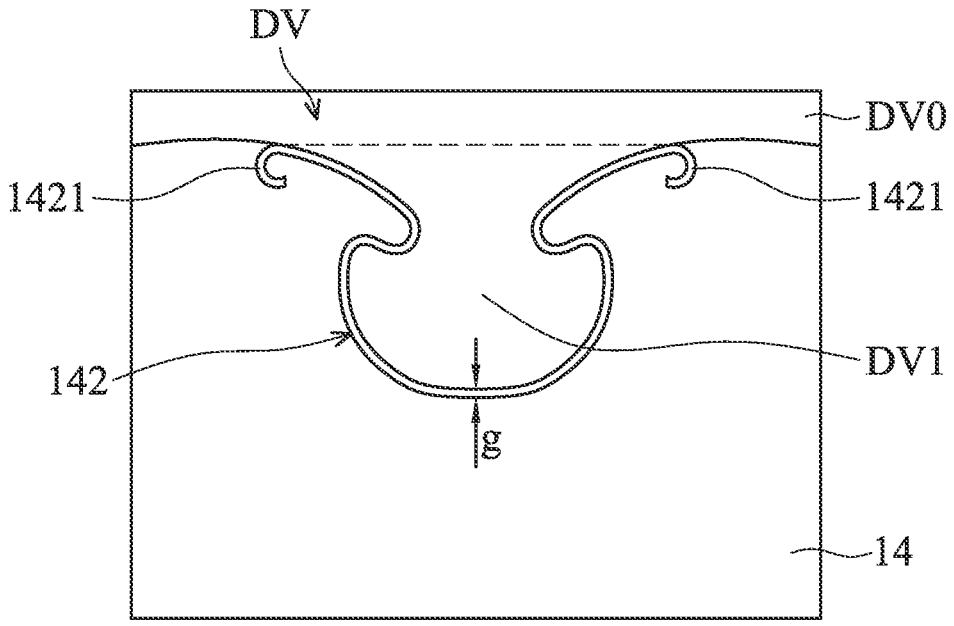
FIG. 17 is a partial enlarged top view of a diaphragm 14 and a dynamic valve layer DV located above the diaphragm 14, in accordance with another embodiment of the invention.

FIG. 17 is a partial enlarged top view of a diaphragm 14 and a dynamic valve layer DV located above the diaphragm 14, in accordance with another embodiment of the invention. Referring to FIG. 17, the diaphragm 14 and the dynamic valve layer DV in this embodiment is different from FIGS. 9-14 in that the dynamic valve layer DV has an annular body DV0 and at least a mushroom-shaped flap portion DV1 extending inward from the annular body DV0. Since the flap portion DV1 of the dynamic valve layer DV does not extend across the vent hole 142, a gap g is formed between the flap portion DV1 and the diaphragm 14 when viewed in a direction perpendicular to the diaphragm 14.

Figure 18:
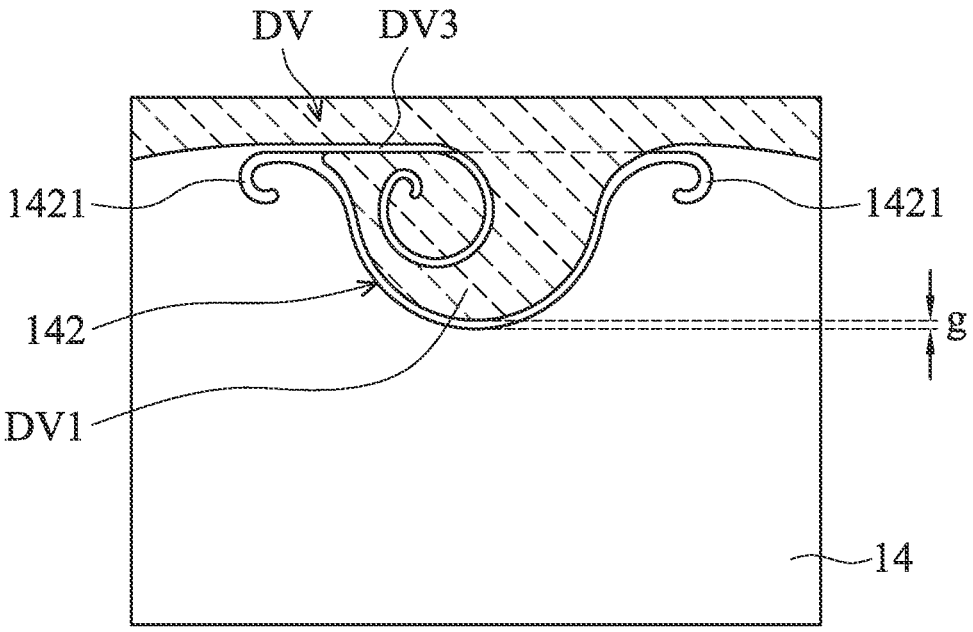
FIG. 18 is a partial enlarged top view of a diaphragm 14 and a dynamic valve layer DV located above the diaphragm 14, in accordance with another embodiment of the invention.

FIG. 18 is a partial enlarged top view of a diaphragm 14 and a dynamic valve layer DV located above the diaphragm 14, in accordance with another embodiment of the invention. Referring to FIG. 18, the diaphragm 14 and the dynamic valve layer DV in this embodiment is different from FIG. 17 in that the flap portion DV1 of the dynamic valve layer DV has a spiral shape, and a slot DV3 is formed between the flap portion DV1 and the annular body DV0, thus increasing the flexibility of the flap portion DV1. Moreover, since the flap portion DV1 of the dynamic valve layer DV does not extend across the vent hole 142, a gap g is formed between the flap portion DV1 and the diaphragm 14 when viewed in a direction perpendicular to the diaphragm 14.

Figure 19:
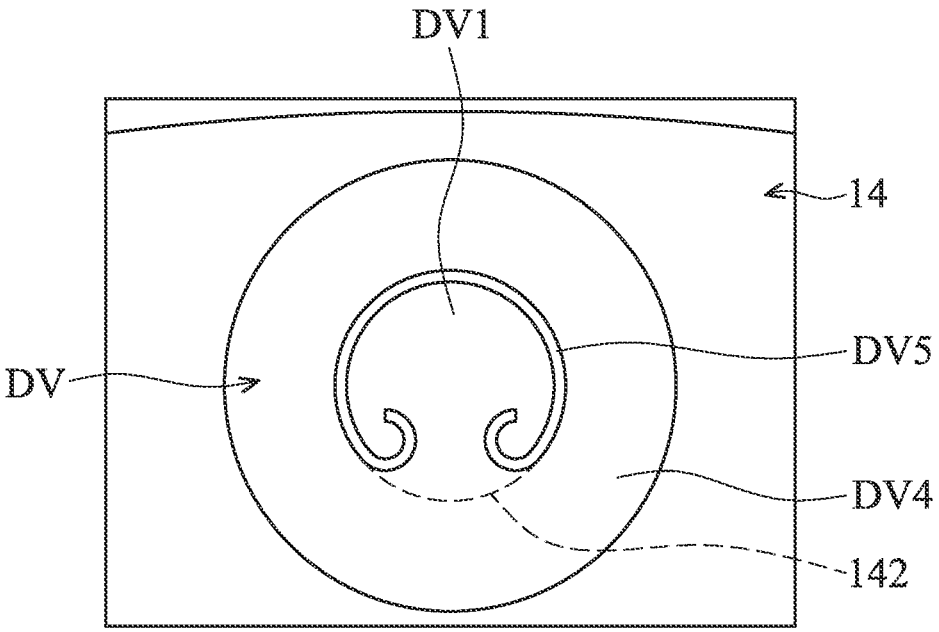
FIG. 19 is a partial enlarged top view of a diaphragm 14 and a dynamic valve layer DV directly formed on the diaphragm 14, in accordance with another embodiment of the invention.
Figure 20:
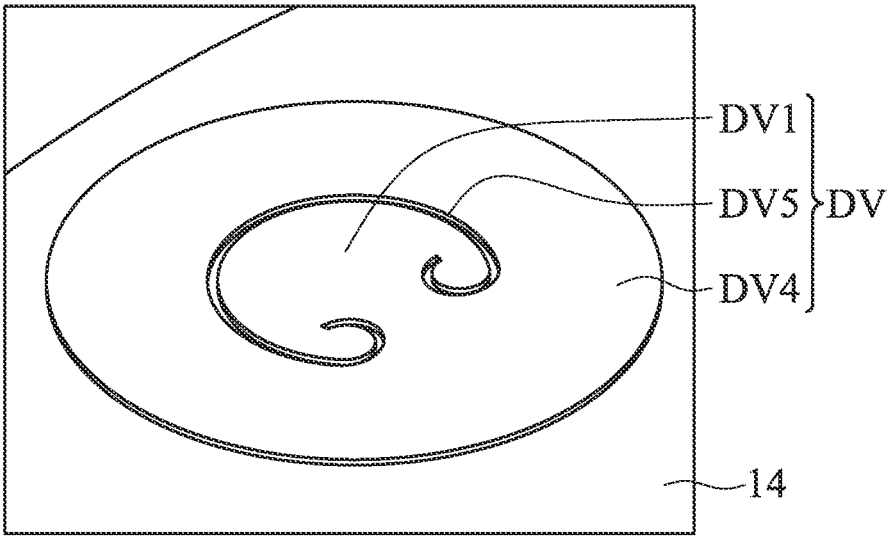
FIG. 20 is a partial enlarged top perspective view of the diaphragm 14 and the dynamic valve layer DV in FIG. 19.
Figure 21:
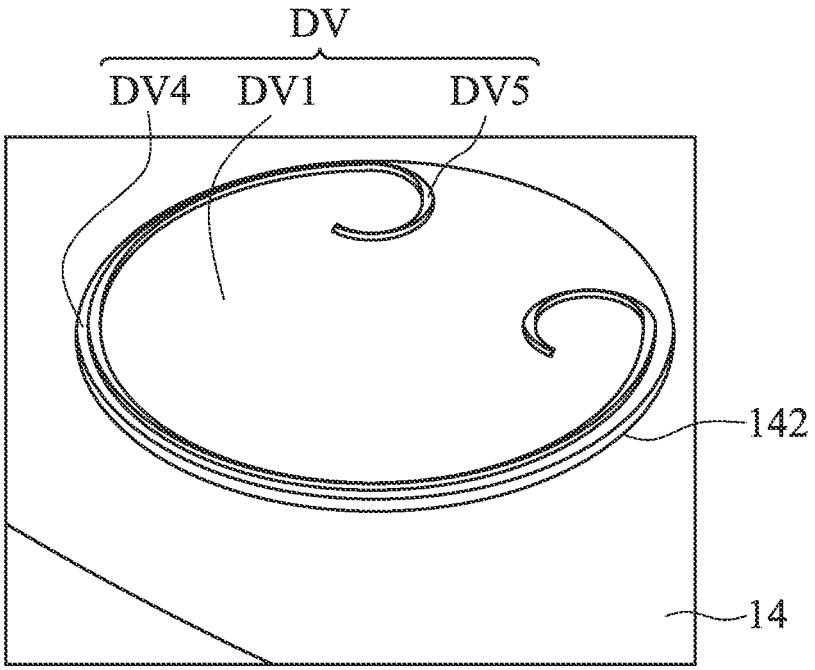
FIG. 21 is a partial enlarged bottom perspective view of the diaphragm 14 and the dynamic valve layer DV in FIG. 19.

FIG. 19 is a partial enlarged top view of a diaphragm 14 and a dynamic valve layer DV directly formed on the diaphragm 14, in accordance with another embodiment of the invention. FIG. 20 is a partial enlarged top perspective view of the diaphragm 14 and the dynamic valve layer DV in FIG. 19. FIG. 21 is a partial enlarged bottom perspective view of the diaphragm 14 and the dynamic valve layer DV in FIG. 19.

Referring to FIGS. 19-21, the dynamic valve layer DV in this embodiment is directly formed on the diaphragm 14. The dynamic valve layer DV includes a flap portion DV1, an annular body DV4 surrounding the flap portion DV1, and a slot DV5 formed between the flap portion DV1 and the annular body DV4. It should be noted that the annular body DV4 is formed on and affixed to the diaphragm 14, and when viewed in a direction perpendicular to the diaphragm 14, the flap portion DV1 is located in a round vent hole 142 of the diaphragm 14, as shown in FIGS. 19 and 21.

Figure 22:
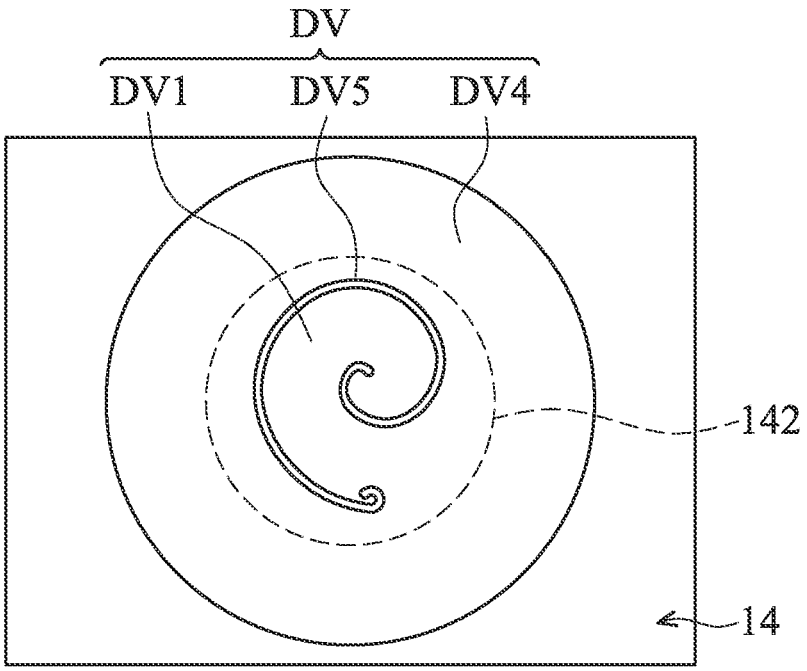
FIG. 22 is a partial enlarged top view of a diaphragm 14 and a dynamic valve layer DV formed on the diaphragm 14, in accordance with another embodiment of the invention.

FIG. 22 is a partial enlarged top view of a diaphragm 14 and a dynamic valve layer DV formed on the diaphragm 14, in accordance with another embodiment of the invention. Referring to FIG. 22, the dynamic valve layer DV in this embodiment is different from FIGS. 19-21 in that the flap portion DV1 of the dynamic valve layer DV has a spiral shape, thus increasing the flexibility of the flap portion DV1. Additionally, when viewed in a direction perpendicular to the diaphragm 14, the slot DV5 is located in the round vent hole 142 of the diaphragm 14.

Figure 23:
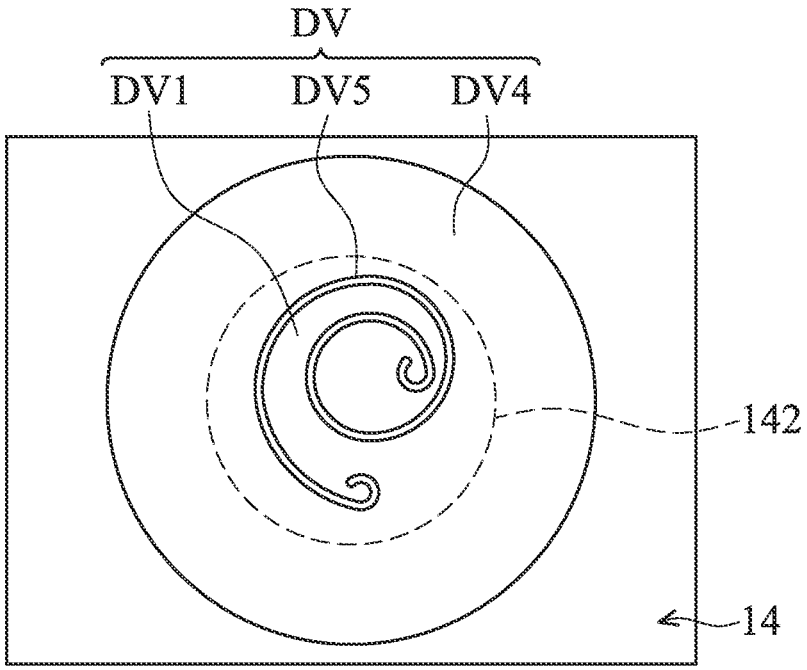
FIG. 23 is a partial enlarged top view of a diaphragm 14 and a dynamic valve layer DV formed on the diaphragm 14, in accordance with another embodiment of the invention.

FIG. 23 is a partial enlarged top view of a diaphragm 14 and a dynamic valve layer DV formed on the diaphragm 14, in accordance with another embodiment of the invention. Referring to FIG. 23, the slot DV5 in this embodiment is much longer than the DV5 in FIG. 22, so as to further increase the flexibility of the flap portion DV1. When viewed in a direction perpendicular to the diaphragm 14, the slot DV5 is located in the round vent hole 142 of the diaphragm 14.

Figure 24:
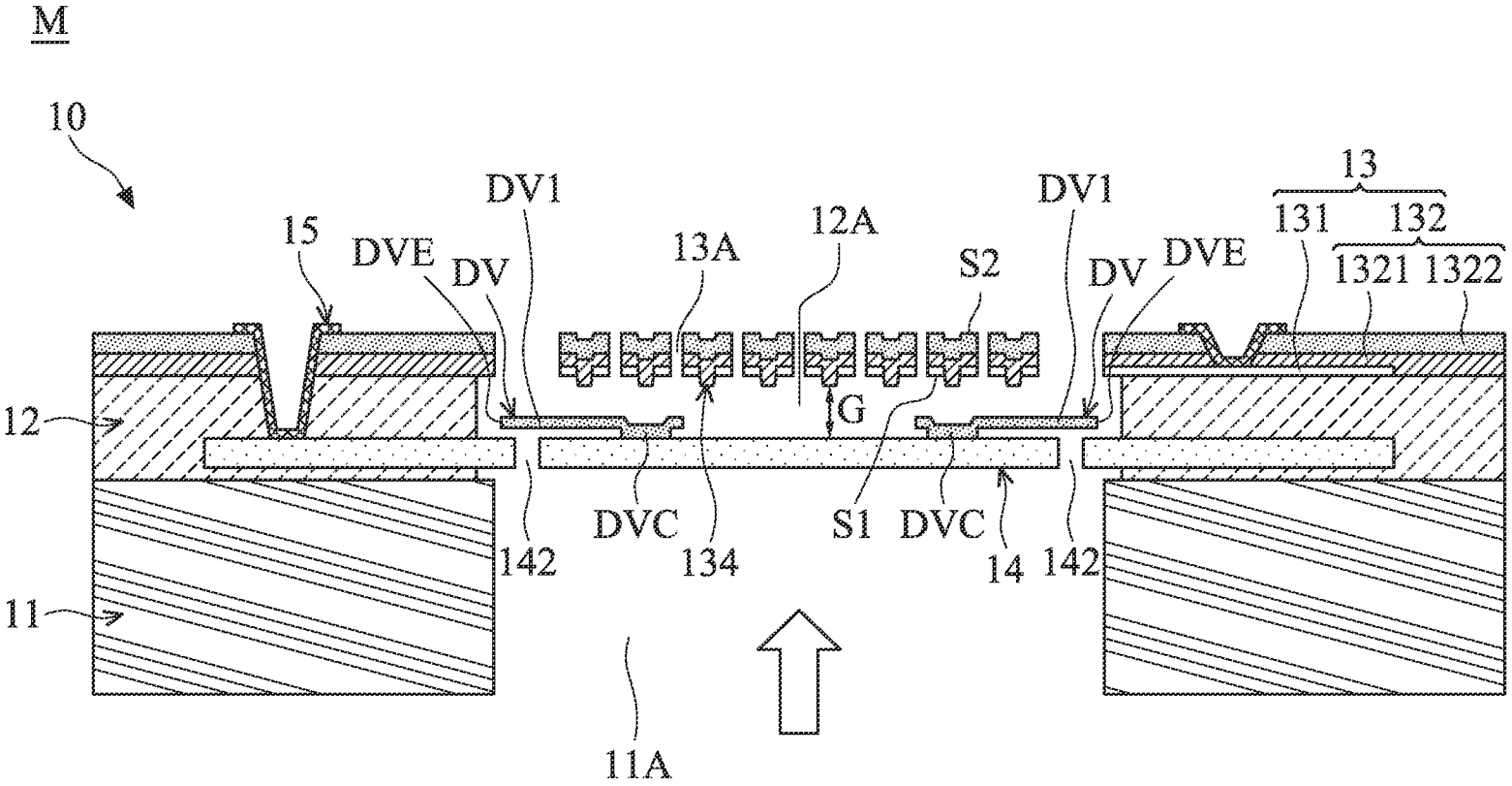
FIG. 24 is a cross-sectional view of a MEMS microphone M, in accordance with another embodiment of the invention.

FIG. 24 is a cross-sectional view of a MEMS microphone M, in accordance with another embodiment of the invention. Referring to FIG. 24, the MEMS microphone M in this embodiment is different from FIG. 1 in that the dynamic valve layer DV is formed on the upper surface of the diaphragm 14. Specifically, the dynamic valve layer DV has at least a connecting portion DVC affixed to the diaphragm 14 and at least a flap portion DV1 extending from the connecting portion DVC, wherein the flap portion DV1 covers the vent hole 142 when viewed in a direction perpendicular to the diaphragm 14.

Here, the dynamic valve layer DV is located between the diaphragm 14 and the backplate 13, and a free end DVE the flap portion DV1 is spaced apart from the diaphragm 14 and the dielectric layer 12. When the diaphragm 14 is affected by acoustic pressure from ambient sound waves, air can flow sequentially through the opening 11A and the vent holes 142, as the arrow indicated in FIG. 24, and the flap portion DV1 of the dynamic valve layer DV can deform to relieve the air pressure and endure the wind load on the diaphragm 14.

Figure 25:
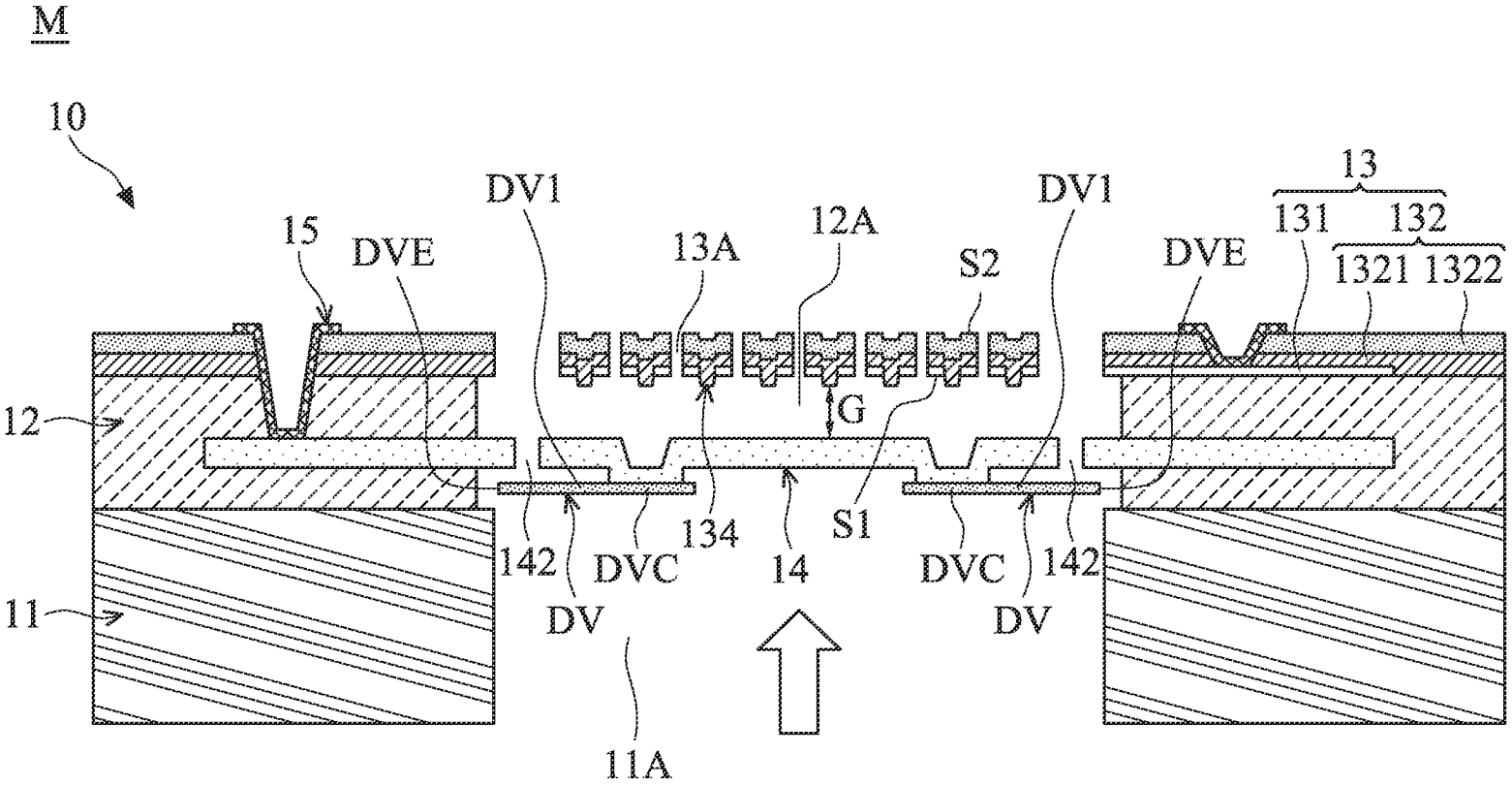
FIG. 25 is a cross-sectional view of a MEMS microphone M, in accordance with another embodiment of the invention.

FIG. 25 is a cross-sectional view of a MEMS microphone M, in accordance with another embodiment of the invention. Referring to FIG. 25, the MEMS microphone M in this embodiment is different from FIG. 24 in that the dynamic valve layer DV is formed on the lower surface of the diaphragm 14, so that the diaphragm 14 is located between the dynamic valve layer DV and the backplate 13.

Figure 26:
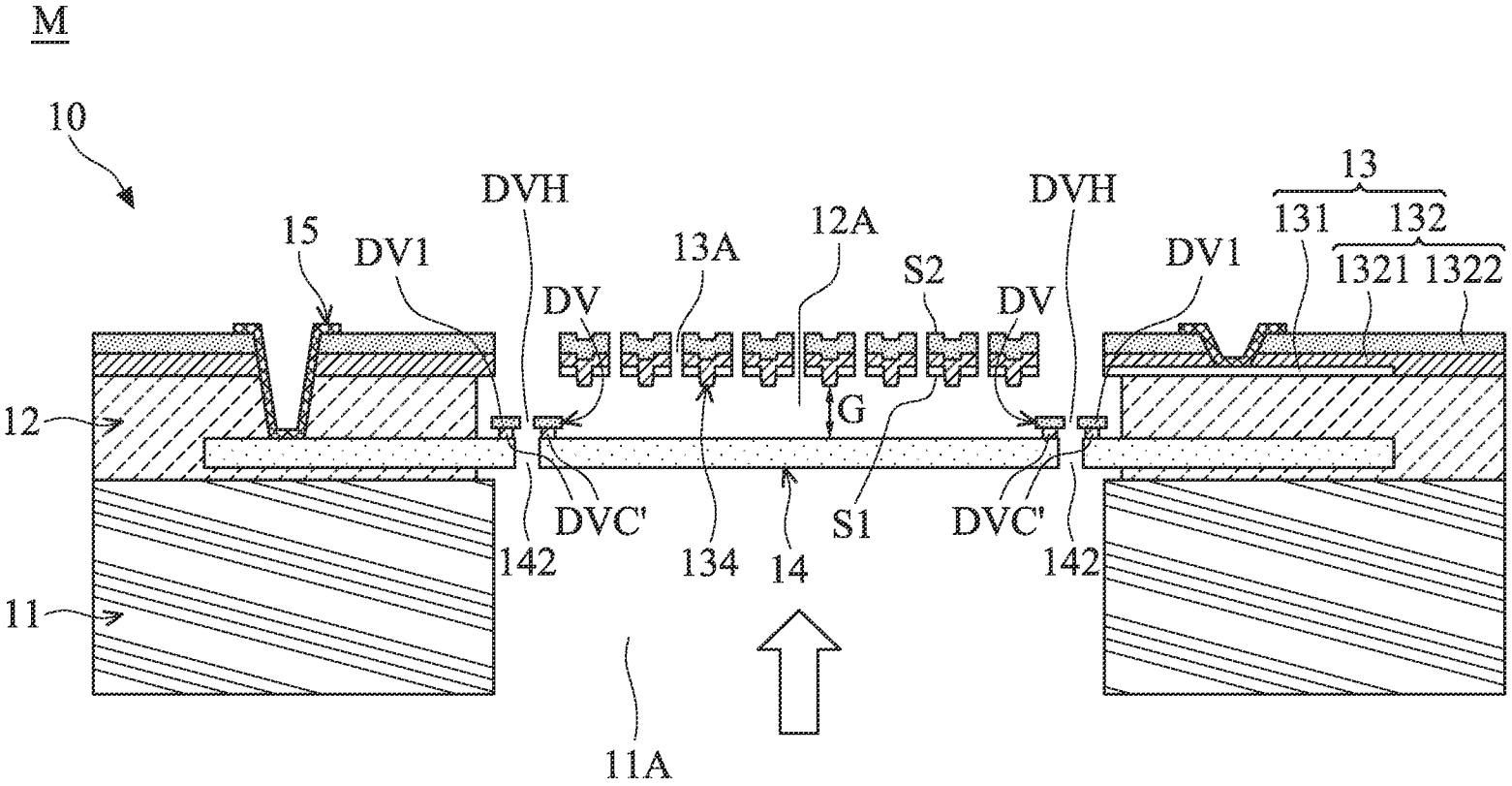
FIG. 26 is a cross-sectional view of a MEMS microphone M, in accordance with another embodiment of the invention.

FIG. 26 is a cross-sectional view of a MEMS microphone M, in accordance with another embodiment of the invention. Referring to FIG. 26, the MEMS microphone M in this embodiment is different from FIG. 24 in that at least a hollow connecting portion DVC' is arranged surrounding a vent hole 142 and stacked on the diaphragm 14, wherein the flap portion DV1 is connected to the connecting portion DVC' and has an opening DVH above the vent hole 142. In this embodiment, the connecting portion DVC' can be a part of the dielectric layer 12. That is, the connecting portion DVC' and the dielectric layer 12 may have the same material and can be produced at the same time, and the flap portion DV1 and the connecting portion DVC' may have different materials.

In some embodiments, one or several connecting portions DVC' may be formed on the diaphragm 14 and surround the vent hole 142 to support the flap portion DV1, so that the flap portion DV1 is spaced apart from the diaphragm 14. When the diaphragm 14 is affected by acoustic pressure from ambient sound waves, air can flow sequentially through the opening 11A and the vent holes 142, as the arrow indicated in FIG. 26, and the flap portion DV1 of the dynamic valve layer DV can deform to relieve the air pressure and endure the wind load on the diaphragm 14.

Figure 27:
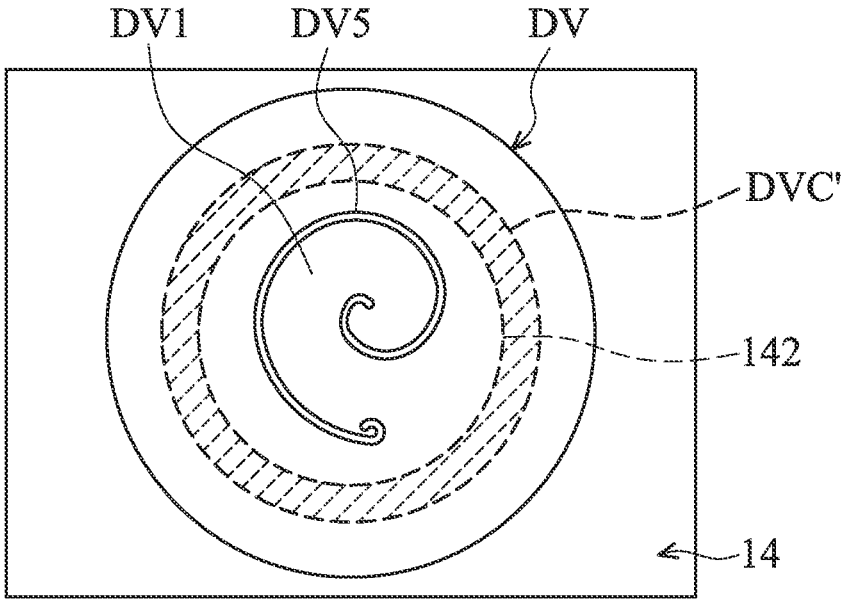
FIG. 27 is a partial enlarged top view of a diaphragm 14 and a dynamic valve layer DV located above the diaphragm 14, in accordance with another embodiment of the invention.

FIG. 27 is a partial enlarged top view of a diaphragm 14 and a dynamic valve layer DV located above the diaphragm 14, in accordance with another embodiment of the invention. In this embodiment, a hollow connecting portion DVC' is formed between the diaphragm 14 and the flap portion DV1 of the dynamic valve layer DV, similar to the connecting portion DVC' in FIG. 26. The connecting portion DVC' surrounds the vent hole 142 on the diaphragm 14 and support the flap portion DV1, so that the flap portion DV1 is spaced apart from the diaphragm 14. Specifically, a spiral slot DV5 is formed in the flap portion DV1, thus increasing the flexibility of the flap portion DV1. When the diaphragm 14 is affected by acoustic pressure from ambient sound waves, air can flow sequentially through the vent hole 142, and the flap portion DV1 of the dynamic valve layer DV can deform to relieve the air pressure and endure the wind load on the diaphragm 14.

In some embodiments, the connecting portion DVC' may also be to formed between the diaphragm 14 and the flap portion DV1 of the dynamic valve layer DV as shown in FIGS. 22 and 23, thereby supporting the flap portion DV1 and relieve the air pressure on the diaphragm 14.

Figure 28:
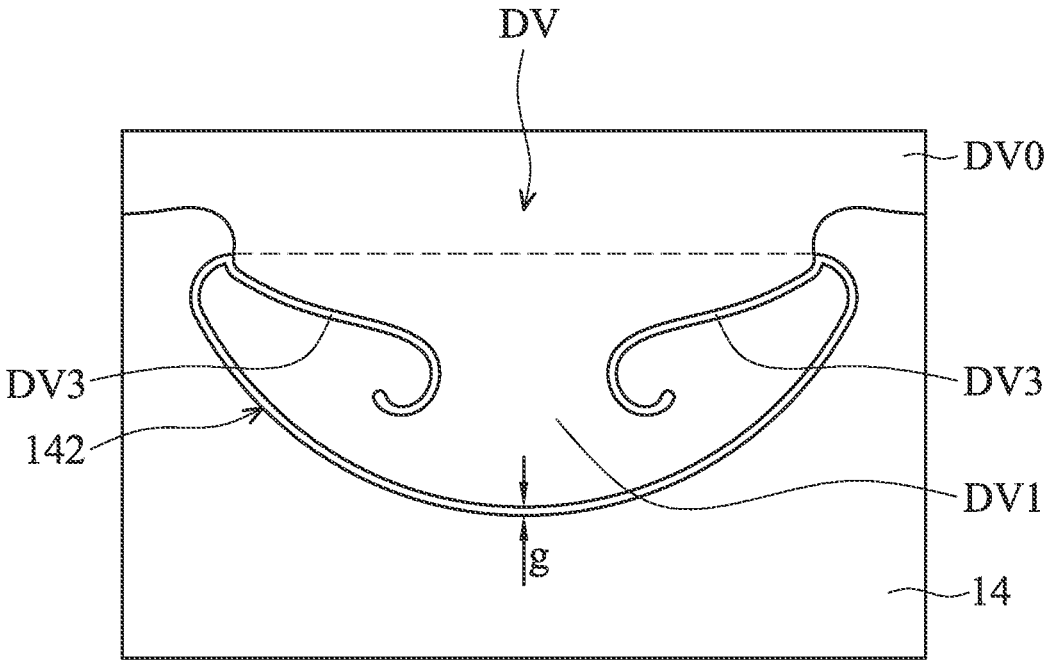
FIG. 28 is a partial enlarged top view of a diaphragm 14 and a dynamic valve layer DV located above the diaphragm 14, in accordance with another embodiment of the invention.

FIG. 28 is a partial enlarged top view of a diaphragm 14 and a dynamic valve layer DV located above the diaphragm 14, in accordance with some embodiments of the invention. Referring to FIG. 28, the diaphragm 14 and the dynamic valve layer DV in this embodiment is different from FIGS. 9-14 in that the dynamic valve layer DV has a flat mushroom-shaped flap portion DV1 extending inward from the annular body DV0, wherein at least one curved slot DV3 is formed on the flap portion DV1, and a gap g is formed between the flap portion DV1 and the diaphragm 14 when viewed in a direction perpendicular to the diaphragm 14.

Figure 29:
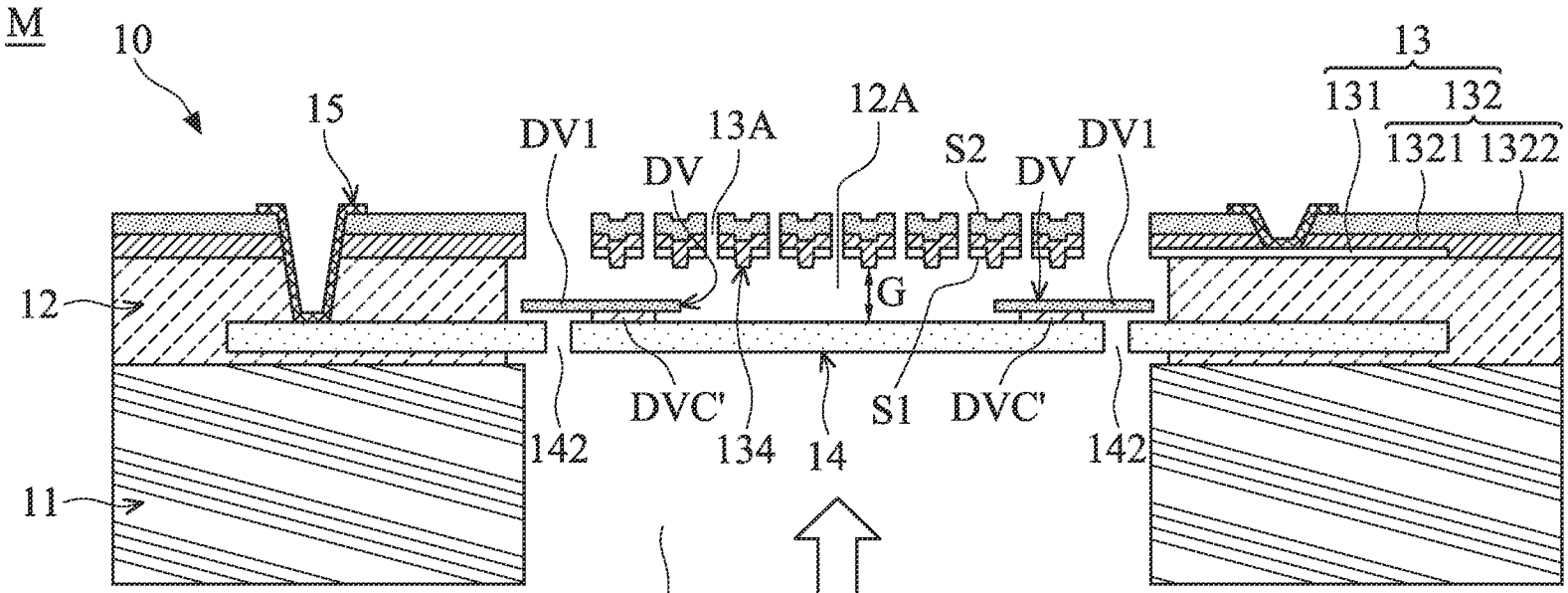
FIG. 29 is a cross-sectional view of a MEMS microphone M, in accordance with another embodiment of the invention.
Figure 30:
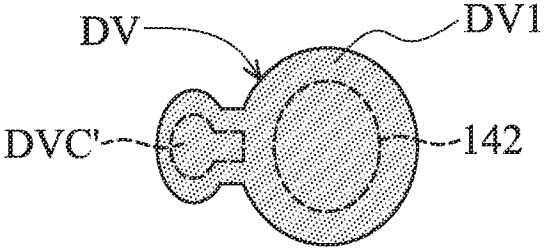
FIG. 30 is top view of the connecting portion DVC', the vent hole 142, and the flap portion DV1 of the dynamic valve layer DV in FIG. 29.

FIG. 29 is a cross-sectional view of a MEMS microphone M, in accordance with another embodiment of the invention, and FIG. 30 is top view of the connecting portion DVC', the vent hole 142, and the flap portion DV1 of the dynamic valve layer DV in FIG. 29.

Referring to FIG. 29, the MEMS microphone M in this embodiment is different from FIG. 24 in that a solid connecting portion DVC' is stacked on the diaphragm 14 and located close to the vent hole 142 for supporting the flap portion DV1 of the dynamic valve layer DV. As shown in FIG. 30, a part of the flap portion DV1 is connected to the connecting portion DVC', and the flap portion DV1 entirely or partially covers the vent hole 142 when viewed in a direction perpendicular to the diaphragm 14.

Figure 31:
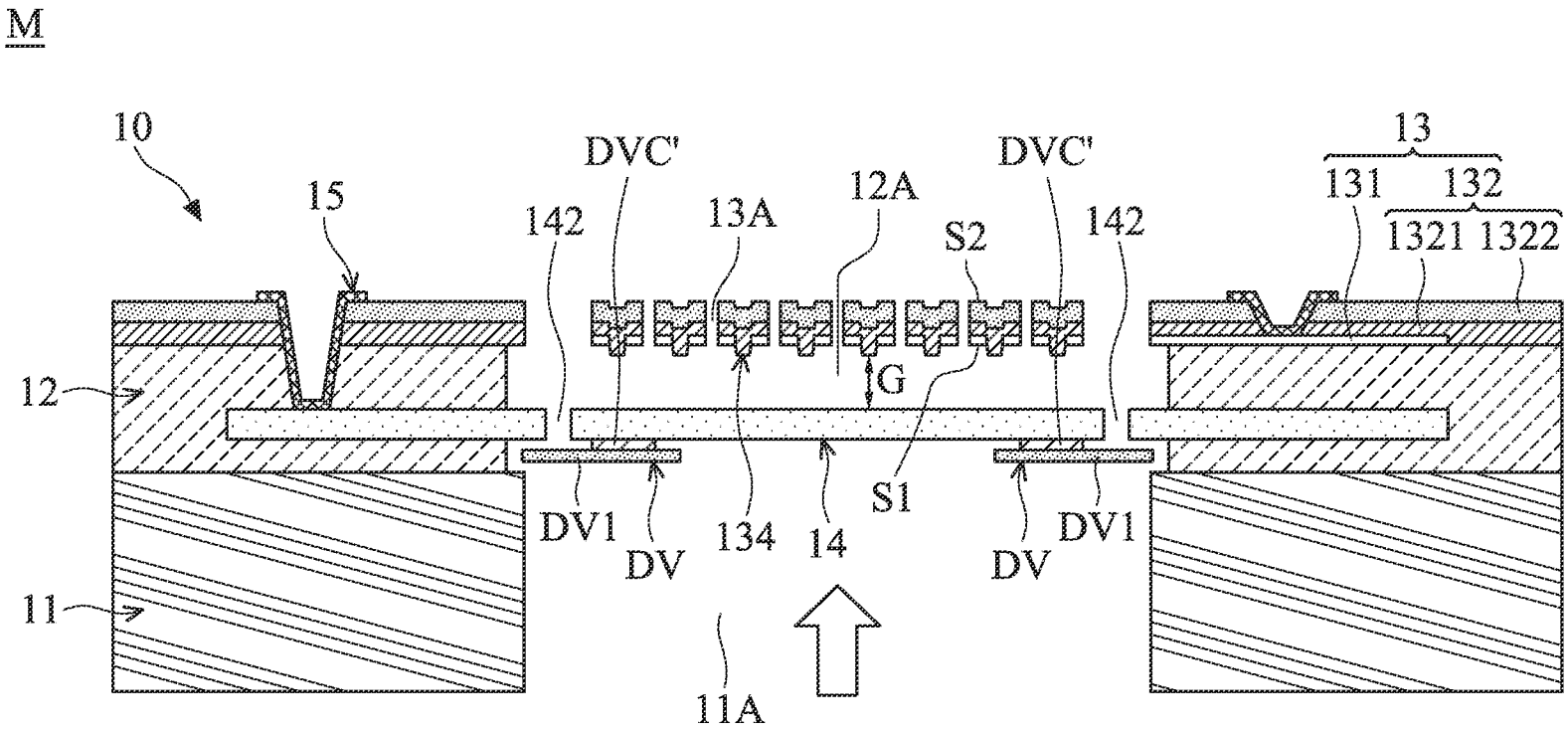
FIG. 31 is a cross-sectional view of a MEMS microphone M, in accordance with another embodiment of the invention.

FIG. 31 is a cross-sectional view of a MEMS microphone M, in accordance with another embodiment of the invention. Referring to FIG. 31, the MEMS microphone M in this embodiment is different from FIG. 29 in that a solid connecting portion DVC' is formed below the diaphragm 14 and located close to the vent hole 142 for supporting the flap portion DV1 of the dynamic valve layer DV. It should be noted that a part of the flap portion DV1 is connected to the connecting portion DVC', and the flap portion DV1 entirely or partially covers the vent hole 142 when viewed in a direction perpendicular to the diaphragm 14.

In the embodiments of FIG. 29 to FIG. 31, the connecting portion DVC' can be a part of the dielectric layer 12. That is, the connecting portion DVC' and the dielectric layer 12 may have the same material and can be produced at the same time, and the flap portion DV1 and the connecting portion DVC' may have different materials.

Although embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A micro-electro-mechanical system (MEMS) device, comprising:

a substrate, forming an opening;

a backplate, disposed on a side of the substrate;

a diaphragm, disposed on the side of the substrate and extending across the opening of the substrate, wherein the diaphragm comprises a vent hole; and a dynamic valve layer, disposed on the side of the substrate and comprising a flap portion, wherein the flap portion covers at least a part of the vent hole when viewed in a direction perpendicular to the diaphragm, and the flap portion deforms when air flows through the vent hole.

2. The micro-electro-mechanical system (MEMS) device of claim 1, further comprising a dielectric layer formed between the substrate and the backplate, wherein a portion of the dynamic valve layer is embedded in the dielectric layer, and the flap portion protrudes from the dielectric layer and is spaced apart from the diaphragm.

3. The micro-electro-mechanical system (MEMS) device of claim 1, wherein the dynamic valve layer is located between the diaphragm and the backplate.

4. The micro-electro-mechanical system (MEMS) device of claim 1, wherein the diaphragm is located between the dynamic valve layer and the backplate.

5. The micro-electro-mechanical system (MEMS) device of claim 1, wherein the dynamic valve layer has an annular body and a plurality of flap portions extending inward from the annular body.

6. The micro-electro-mechanical system (MEMS) device of claim 5, wherein a curved slot is formed on the flap portion and communicated with the vent hole.

7. The micro-electro-mechanical system (MEMS) device of claim 1, wherein the flap portion entirely or partially covers the vent hole when viewed in the direction perpendicular to the diaphragm.

8. The micro-electro-mechanical system (MEMS) device of claim 7, wherein a curved slot is formed on the flap portion and communicated with the vent hole.

9. The micro-electro-mechanical system (MEMS) device of claim 1, wherein the flap portion has a protrusion facing the diaphragm.

10. The micro-electro-mechanical system (MEMS) device of claim 9, wherein the protrusion overlaps the diaphragm when viewed in the direction perpendicular to the diaphragm.

11. The micro-electro-mechanical system (MEMS) device of claim 9, wherein the protrusion has a non-uniform thickness or forms a multilayer structure.

12. The micro-electro-mechanical system (MEMS) device of claim 9, wherein the protrusion has a concave or convex structure and extends into the vent hole.

13. The micro-electro-mechanical system (MEMS) device of claim 9, wherein the protrusion extends across the vent hole.

14. The micro-electro-mechanical system (MEMS) device of claim 9, wherein the flap portion has a plurality of protrusions facing the diaphragm and located close to an edge of the flap portion.

15. The micro-electro-mechanical system (MEMS) device of claim 14, wherein the protrusions overlap the diaphragm when viewed in the direction perpendicular to the diaphragm.

16. The micro-electro-mechanical system (MEMS) device of claim 1, further comprising a plurality of ribs formed on the diaphragm and extending toward an interior of the vent hole.

17. The micro-electro-mechanical system (MEMS) device of claim 1, further comprising a plurality of ribs formed on the dynamic valve layer and extending toward an interior of the vent hole.

18. The micro-electro-mechanical system (MEMS) device of claim 1, wherein a gap is formed between the flap portion and the diaphragm when viewed in the direction perpendicular to the diaphragm.

19. The micro-electro-mechanical system (MEMS) device of claim 1, wherein the flap portion of the dynamic valve layer is tadpole-shaped, mushroom-shaped or spiral shaped.

20. The micro-electro-mechanical system (MEMS) device of claim 1, wherein the dynamic valve layer is directly formed on the diaphragm.

21. The micro-electro-mechanical system (MEMS) device of claim 20, wherein the dynamic valve layer has an annular body formed on the diaphragm, and a curved slot is formed on the flap portion.

22. The micro-electro-mechanical system (MEMS) device of claim 1, further comprising a dielectric layer formed between the substrate and the backplate, wherein the dynamic valve layer comprises a plurality of fixed portions and a plurality of flap portions extending from the fixed portions, the fixed portions are embedded in the dielectric layer and spaced apart from each other, and the flap portions protrude from the dielectric layer and are spaced apart from the diaphragm.

23. The micro-electro-mechanical system (MEMS) device of claim 1, wherein the dynamic valve layer is supported by a connecting portion which is stacked on the diaphragm.

* * * * *